US008434568B2

(12) United States Patent
Zupanick

(10) Patent No.: US 8,434,568 B2
(45) **Date of Patent: *May 7, 2013**

(54) METHOD AND SYSTEM FOR CIRCULATING FLUID IN A WELL SYSTEM

(75) Inventor: Joseph A. Zupanick, Pineville, WV (US)

(73) Assignee: Vitruvian Exploration, LLC, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/188,250

(22) Filed: Jul. 22, 2005

(65) Prior Publication Data

US 2005/0257962 A1 Nov. 24, 2005

Related U.S. Application Data

(60) Division of application No. 10/323,192, filed on Dec. 18, 2002, now Pat. No. 7,025,154, which is a continuation-in-part of application No. 09/788,897, filed on Feb. 20, 2001, now Pat. No. 6,732,792, which is a division of application No. 09/444,029, filed on Nov. 19, 1999, now Pat. No. 6,357,523, which is a continuation-in-part of application No. 09/197,687, filed on Nov. 20, 1998, now Pat. No. 6,280,000.

(51) Int. Cl.
*E21B 43/30* (2006.01)

(52) U.S. Cl.
USPC ..... 175/72; 166/50; 166/52

(58) Field of Classification Search ..... 166/50, 166/52; 175/72, 60
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |

(Continued)

FOREIGN PATENT DOCUMENTS

| | | | |
|---|---|---|---|
| AU | 85/49964 | A | 11/1986 |
| CA | 2210866 | | 1/1998 |

(Continued)

OTHER PUBLICATIONS

McCray, Arthur, et al., "*Oil Well Drilling Technology*," University of Oklahoma Press, 1959, Title Page, Copyright Page and pp. 315-319 (7 pages).

(Continued)

*Primary Examiner* — John Kreck
(74) *Attorney, Agent, or Firm* — Fish & Richardson P.C.

(57) ABSTRACT

A method for circulating drilling fluid in a well system includes drilling a substantially vertical well bore from a surface to a subterranean zone and drilling an articulated well bore from the surface to the subterranean zone. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The method also includes providing fluid down the substantially vertical well bore through a tubing. A fluid mixture returns up the substantially vertical well bore outside of the tubing. The fluid mixture comprises the drilling fluid after the drilling fluid exits the drill string.

25 Claims, 4 Drawing Sheets

U.S. PATENT DOCUMENTS

| | | | |
|---|---|---|---|
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Böll et al. |
| 2,335,085 | A | 11/1943 | Roberts |
| 2,450,223 | A | 9/1948 | Barbour |
| 2,452,654 | A | 11/1948 | Hayes et al. |
| 2,490,350 | A | 12/1949 | Grable |
| 2,679,903 | A | 6/1954 | McGowen, Jr. et al. |
| 2,726,063 | A | 12/1955 | Ragland et al. |
| 2,726,847 | A | 12/1955 | McCune et al. |
| 2,783,018 | A | 2/1957 | Lytle |
| 2,797,893 | A | 7/1957 | McCune et al. |
| 2,847,189 | A | 8/1958 | Shook |
| 2,911,008 | A | 11/1959 | Du Bois |
| 2,934,904 | A | 5/1960 | Hendrix |
| 2,980,142 | A | 4/1961 | Turak |
| 3,135,293 | A | 6/1964 | Hulsey |
| 3,163,211 | A | 12/1964 | Henley |
| 3,208,537 | A | 9/1965 | Scarborough |
| 3,347,595 | A | 10/1967 | Dahms et al. |
| 3,362,475 | A | 1/1968 | Huitt et al. |
| 3,385,382 | A | 5/1968 | Canalizo et al. |
| 3,406,766 | A | 10/1968 | Henderson |
| 3,443,648 | A | 5/1969 | Howard |
| 3,473,571 | A | 10/1969 | Dugay |
| 3,503,377 | A | 3/1970 | Beatenbough et al. |
| 3,528,516 | A | 9/1970 | Brown |
| 3,530,675 | A | 9/1970 | Turzillo |
| 3,534,822 | A | 10/1970 | Campbell et al. |
| 3,578,077 | A | 5/1971 | Glenn, Jr. et al. |
| 3,582,138 | A | 6/1971 | Loofbourow et al. |
| 3,587,743 | A | 6/1971 | Howard |
| 3,647,230 | A | 3/1972 | Smedley |
| 3,684,041 | A | 8/1972 | Kammerer, Jr. et al. |
| 3,687,204 | A | 8/1972 | Marshall et al. |
| 3,692,041 | A | 9/1972 | Bondi |
| 3,744,565 | A | 7/1973 | Brown |
| 3,757,876 | A | 9/1973 | Pereau |
| 3,757,877 | A | 9/1973 | Leathers |
| 3,759,328 | A | 9/1973 | Ueber et al. |
| 3,763,652 | A | 10/1973 | Rinta |
| 3,800,830 | A | 4/1974 | Etter |
| 3,809,519 | A | 5/1974 | Garner |
| 3,825,081 | A | 7/1974 | McMahon |
| 3,828,867 | A | 8/1974 | Elwood |
| 3,874,413 | A | 4/1975 | Valdez |
| 3,887,008 | A | 6/1975 | Canfield |
| 3,902,322 | A | 9/1975 | Watanabe |
| 3,907,045 | A | 9/1975 | Dahl et al. |
| 3,934,649 | A | 1/1976 | Pasini, III et al. |
| 3,957,082 | A | 5/1976 | Fuson et al. |
| 3,961,824 | A | 6/1976 | Van Eek et al. |
| 4,011,890 | A | 3/1977 | Andersson |
| 4,020,901 | A | 5/1977 | Pisio et al. |
| 4,022,279 | A | 5/1977 | Driver |
| 4,030,310 | A | 6/1977 | Schirtzinger |
| 4,037,658 | A | 7/1977 | Anderson |
| 4,060,130 | A | 11/1977 | Hart |
| 4,073,351 | A | 2/1978 | Baum |
| 4,077,069 | A | 3/1978 | Perkins |
| 4,089,374 | A | 5/1978 | Terry |
| 4,106,575 | A | 8/1978 | Bunnelle |
| 4,116,012 | A | 9/1978 | Abe et al. |
| 4,134,463 | A | 1/1979 | Allen |
| 4,136,996 | A | 1/1979 | Burns |
| 4,137,975 | A | 2/1979 | Pennock |
| 4,151,880 | A | 5/1979 | Vann |
| 4,156,437 | A | 5/1979 | Chivens et al. |
| 4,169,510 | A | 10/1979 | Meigs |
| 4,182,423 | A | 1/1980 | Ziebarth et al. |
| 4,189,184 | A | 2/1980 | Green |
| 4,220,203 | A | 9/1980 | Steeman |
| 4,221,433 | A | 9/1980 | Jacoby |
| 4,222,611 | A | 9/1980 | Larson et al. |
| 4,224,989 | A | 9/1980 | Blount |
| 4,226,475 | A | 10/1980 | Frosch et al. |
| 4,257,650 | A | 3/1981 | Allen |
| 4,278,137 | A | 7/1981 | Van Eek |
| 4,283,088 | A | 8/1981 | Tabakov et al. |
| 4,296,785 | A | 10/1981 | Vitello et al. |
| 4,296,969 | A | 10/1981 | Willman |
| 4,299,295 | A | 11/1981 | Gossard |
| 4,303,127 | A | 12/1981 | Freel et al. |
| 4,305,464 | A | 12/1981 | Masszi |
| 4,312,377 | A | 1/1982 | Knecht |
| 4,317,492 | A | 3/1982 | Summers et al. |
| 4,328,577 | A | 5/1982 | Abbott et al. |
| 4,333,539 | A | 6/1982 | Lyons et al. |
| 4,356,866 | A | 11/1982 | Savins |
| 4,366,988 | A | 1/1983 | Bodine |
| 4,372,398 | A | 2/1983 | Kuckes |
| 4,386,665 | A | 6/1983 | Dellinger |
| 4,390,067 | A * | 6/1983 | Willman ..... 166/245 |
| 4,396,075 | A | 8/1983 | Wood et al. |
| 4,396,076 | A | 8/1983 | Inoue |
| 4,397,360 | A | 8/1983 | Schmidt |
| 4,401,171 | A | 8/1983 | Fuchs |
| 4,407,376 | A | 10/1983 | Inoue |
| 4,415,205 | A | 11/1983 | Rehm et al. |
| 4,417,829 | A | 11/1983 | Berezoutzky |
| 4,422,505 | A | 12/1983 | Collins |
| 4,437,706 | A | 3/1984 | Johnson |
| 4,442,896 | A | 4/1984 | Reale et al. |
| 4,458,767 | A | 7/1984 | Hoehn, Jr. |
| 4,463,988 | A | 8/1984 | Bouck et al. |
| 4,494,616 | A | 1/1985 | McKee |
| 4,502,733 | A | 3/1985 | Grubb |
| 4,512,422 | A | 4/1985 | Knisley |
| 4,519,463 | A | 5/1985 | Schuh |
| 4,527,639 | A | 7/1985 | Dickinson, III et al. |
| 4,532,986 | A | 8/1985 | Mims et al. |
| 4,533,182 | A | 8/1985 | Richards |
| 4,536,035 | A | 8/1985 | Huffman et al. |
| 4,544,037 | A | 10/1985 | Terry |
| 4,558,744 | A | 12/1985 | Gibb |
| 4,565,252 | A | 1/1986 | Campbell et al. |
| 4,573,541 | A | 3/1986 | Josse et al. |
| 4,600,061 | A | 7/1986 | Richards |
| 4,603,592 | A | 8/1986 | Siebold et al. |
| 4,605,067 | A | 8/1986 | Burton, Jr. |
| 4,605,076 | A | 8/1986 | Goodhart |
| 4,611,855 | A | 9/1986 | Richards |
| 4,618,009 | A | 10/1986 | Carter et al. |
| 4,638,949 | A | 1/1987 | Mancel |
| 4,646,836 | A | 3/1987 | Goodhart |
| 4,651,836 | A | 3/1987 | Richards |
| 4,662,440 | A | 5/1987 | Harmon et al. |
| 4,674,579 | A | 6/1987 | Geller et al. |
| 4,676,313 | A | 6/1987 | Rinaldi |
| 4,702,314 | A | 10/1987 | Huang et al. |
| 4,705,109 | A | 11/1987 | Ledent et al. |
| 4,705,431 | A | 11/1987 | Gadelle et al. |
| 4,715,440 | A | 12/1987 | Boxell et al. |
| 4,718,485 | A | 1/1988 | Brown et al. |
| RE32,623 | E | 3/1988 | Marshall et al. |
| 4,727,937 | A | 3/1988 | Shum et al. |
| 4,753,485 | A | 6/1988 | Goodhart |
| 4,754,808 | A | 7/1988 | Harmon et al. |
| 4,754,819 | A | 7/1988 | Dellinger |
| 4,756,367 | A | 7/1988 | Puri et al. |
| 4,763,734 | A | 8/1988 | Dickinson et al. |
| 4,773,488 | A | 9/1988 | Bell et al. |
| 4,776,638 | A | 10/1988 | Hahn |
| 4,830,105 | A | 5/1989 | Petermann |
| 4,832,122 | A | 5/1989 | Corey et al. |
| 4,836,611 | A | 6/1989 | El-Saie |
| 4,842,081 | A | 6/1989 | Parant |
| 4,844,182 | A | 7/1989 | Tolle |

4,852,666 A 8/1989 Brunet et al.
4,883,122 A 11/1989 Puri et al.
4,889,186 A 12/1989 Hanson et al.
4,978,172 A 12/1990 Schwoebel et al.
5,016,709 A 5/1991 Combe et al.
5,016,710 A 5/1991 Renard et al.
5,033,550 A 7/1991 Johnson et al.
5,035,605 A 7/1991 Dinerman et al.
5,036,921 A 8/1991 Pittard et al.
5,040,601 A 8/1991 Karlsson et al.
5,074,360 A 12/1991 Guinn
5,074,365 A 12/1991 Kuckes
5,074,366 A 12/1991 Karlsson et al.
5,082,054 A 1/1992 Kiamanesh
5,111,893 A 5/1992 Kvello-Aune
5,115,872 A 5/1992 Brunet et al.
5,127,457 A 7/1992 Stewart et al.
5,135,058 A 8/1992 Millgard et al.
5,148,875 A 9/1992 Karlsson et al.
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno
5,197,783 A 3/1993 Theimer et al.
5,199,496 A 4/1993 Redus et al.
5,201,817 A 4/1993 Hailey
5,207,271 A 5/1993 Sanchez et al.
5,217,076 A 6/1993 Masek
5,226,495 A 7/1993 Jennings, Jr.
5,240,350 A 8/1993 Yamaguchi et al.
5,242,017 A 9/1993 Hailey
5,242,025 A 9/1993 Neill et al.
5,246,273 A 9/1993 Rosar
5,255,741 A 10/1993 Alexander
5,271,472 A 12/1993 Leturno
5,287,926 A 2/1994 Grupping
5,289,888 A 3/1994 Talley
5,301,760 A 4/1994 Graham
5,343,965 A 9/1994 Talley et al.
5,355,967 A 10/1994 Mueller et al.
5,363,927 A 11/1994 Frank
5,385,205 A 1/1995 Hailey
5,394,950 A 3/1995 Gardes
5,402,851 A 4/1995 Baiton
5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,431,220 A 7/1995 Lennon et al.
5,431,482 A 7/1995 Russo
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud
5,499,687 A 3/1996 Lee
5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,664,911 A 9/1997 Bridges et al.
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,727,629 A 3/1998 Blizzard, Jr. et al.
5,733,067 A 3/1998 Hunt et al.
5,735,350 A 4/1998 Longbottom et al.
5,771,976 A 6/1998 Talley
5,775,433 A 7/1998 Hammett et al.
5,775,443 A 7/1998 Lott
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A 5/2000 Gourley et al.
6,079,495 A 6/2000 Ohmer
6,089,322 A 7/2000 Kelley et al.
6,119,771 A 9/2000 Gano et al.
6,119,776 A 9/2000 Graham et al.
6,135,208 A 10/2000 Gano et al.
6,170,571 B1 1/2001 Ohmer
6,179,054 B1 1/2001 Stewart
6,189,616 B1 2/2001 Gano et al.
6,192,988 B1 2/2001 Tubel
6,199,633 B1 3/2001 Longbottom
6,209,636 B1 4/2001 Roberts et al.
6,223,839 B1 5/2001 Fraim et al.
6,237,284 B1 5/2001 Erickson
6,244,340 B1 6/2001 McGlothen et al.
6,247,532 B1 6/2001 Ohmer
6,250,391 B1 6/2001 Proudfoot
6,263,965 B1 7/2001 Schmidt et al.
6,279,658 B1 8/2001 Donovan et al.
6,280,000 B1 8/2001 Zupanick
6,283,216 B1 9/2001 Ohmer
6,318,457 B1 11/2001 Den Boer et al.
6,349,769 B1 2/2002 Ohmer
6,357,523 B1 * 3/2002 Zupanick ..... 166/52
6,357,530 B1 3/2002 Kennedy et al.
6,425,448 B1 7/2002 Zupanick et al.
6,439,320 B2 8/2002 Zupanick
6,450,256 B2 9/2002 Mones
6,454,000 B1 9/2002 Zupanick
6,457,525 B1 10/2002 Scott
6,457,540 B2 10/2002 Gardes
6,470,978 B2 10/2002 Trueman et al.
6,478,085 B2 11/2002 Zupanick
6,491,101 B2 12/2002 Ohmer
6,497,556 B2 12/2002 Zupanick et al.
6,554,063 B2 4/2003 Ohmer
6,557,628 B2 5/2003 Ohmer
6,561,277 B2 5/2003 Algeory et al.
6,561,288 B2 * 5/2003 Zupanick ..... 175/69
6,564,867 B2 5/2003 Ohmer
6,566,649 B1 5/2003 Mickael
6,571,888 B2 6/2003 Comeau et al.

| | | | | |
|---|---|---|---|---|
| 6,575,235 | B2 | 6/2003 | Zupanick et al. | |
| 6,575,255 | B1 | 6/2003 | Rial et al. | |
| 6,577,129 | B1 | 6/2003 | Thompson et al. | |
| 6,581,455 | B1 | 6/2003 | Berger et al. | |
| 6,581,685 | B2 | 6/2003 | Burgess et al. | |
| 6,585,061 | B2 | 7/2003 | Radzinski et al. | |
| 6,590,202 | B2 | 7/2003 | Mickael | |
| 6,591,903 | B2 | 7/2003 | Ingle et al. | |
| 6,591,922 | B1 | 7/2003 | Rial et al. | |
| 6,595,301 | B1 | 7/2003 | Diamond et al. | |
| 6,595,302 | B1 | 7/2003 | Diamond et al. | |
| 6,598,686 | B1 | 7/2003 | Zupanick | |
| 6,604,580 | B2 | 8/2003 | Zupanick et al. | |
| 6,604,910 | B1 | 8/2003 | Zupanick | |
| 6,607,042 | B2 | 8/2003 | Hoyer et al. | |
| 6,636,159 | B1 | 10/2003 | Winnacker | |
| 6,639,210 | B2 | 10/2003 | Odom et al. | |
| 6,644,422 | B1 | 11/2003 | Rial et al. | |
| 6,646,441 | B2 | 11/2003 | Thompson et al. | |
| 6,653,839 | B2 | 11/2003 | Yuratich et al. | |
| 6,662,870 | B1 * | 12/2003 | Zupanick et al. | 166/245 |
| 6,668,918 | B2 | 12/2003 | Zupanick | |
| 6,679,322 | B1 | 1/2004 | Zupanick | |
| 6,681,855 | B2 | 1/2004 | Zupanick et al. | |
| 6,688,388 | B2 | 2/2004 | Zupanick | |
| 6,708,764 | B2 | 3/2004 | Zupanick | |
| 6,722,452 | B1 | 4/2004 | Rial et al. | |
| 6,725,922 | B2 | 4/2004 | Zupanick | |
| 6,732,792 | B2 | 5/2004 | Zupanick | |
| 6,745,855 | B2 | 6/2004 | Gardes | |
| 6,758,279 | B2 | 7/2004 | Moore et al. | |
| 6,758,289 | B2 | 7/2004 | Kelley et al. | |
| 6,766,859 | B2 | 7/2004 | Haugen et al. | |
| RE38,642 | E | 11/2004 | Gondouin | |
| 6,848,508 | B2 | 2/2005 | Zupanick | |
| 6,851,479 | B1 | 2/2005 | Zupanick et al. | |
| 6,860,147 | B2 | 3/2005 | Gunter et al. | |
| 6,866,106 | B2 | 3/2005 | Trueman et al. | |
| 6,923,275 | B2 | 8/2005 | Gardes | |
| 6,932,168 | B2 | 8/2005 | Morgan et al. | |
| 6,942,030 | B2 | 9/2005 | Zupanick | |
| 6,953,088 | B2 | 10/2005 | Rial et al. | |
| 6,962,030 | B2 | 11/2005 | Conn | |
| 6,964,298 | B2 | 11/2005 | Zupanick | |
| 6,964,308 | B1 | 11/2005 | Zupanick | |
| 6,968,893 | B2 | 11/2005 | Rusby et al. | |
| 6,976,533 | B2 | 12/2005 | Zupanick | |
| 6,976,547 | B2 | 12/2005 | Rial et al. | |
| 6,986,388 | B2 | 1/2006 | Zupanick et al. | |
| 6,988,548 | B2 | 1/2006 | Diamond et al. | |
| 6,991,047 | B2 | 1/2006 | Zupanick | |
| 6,991,048 | B2 | 1/2006 | Zupanick | |
| 7,073,595 | B2 * | 7/2006 | Zupanick et al. | 166/370 |
| 7,387,165 | B2 | 6/2008 | Lopez de Cardenas et al. | |
| 7,543,648 | B2 | 6/2009 | Hill et al. | |
| 2002/0043404 | A1 | 4/2002 | Trueman et al. | |
| 2002/0096336 | A1 | 7/2002 | Zupanick et al. | |
| 2002/0189801 | A1 | 12/2002 | Zupanick et al. | |
| 2003/0234120 | A1 | 12/2003 | Paluch et al. | |
| 2004/0007353 | A1 | 1/2004 | Stave | |
| 2004/0033557 | A1 | 2/2004 | Scott et al. | |
| 2004/0035582 | A1 | 2/2004 | Zupanick | |
| 2004/0050552 | A1 | 3/2004 | Zupanick | |
| 2004/0050554 | A1 | 3/2004 | Zupanick et al. | |
| 2004/0055787 | A1 | 3/2004 | Zupanick | |
| 2004/0108110 | A1 | 6/2004 | Zupanick | |
| 2004/0140129 | A1 | 7/2004 | Gardes | |
| 2004/0206493 | A1 | 10/2004 | Zupanick et al. | |
| 2004/0244974 | A1 | 12/2004 | Zupanick et al. | |
| 2005/0087340 | A1 | 4/2005 | Zupanick et al. | |
| 2005/0103490 | A1 | 5/2005 | Paulcy | |
| 2005/0109505 | A1 | 5/2005 | Seams | |
| 2005/0115709 | A1 | 6/2005 | Zupanick et al. | |
| 2005/0133219 | A1 | 6/2005 | Zupanick | |
| 2005/0161216 | A1 | 7/2005 | Zupanick | |
| 2005/0167156 | A1 | 8/2005 | Zupanick | |
| 2005/0189114 | A1 | 9/2005 | Zupanick | |
| 2005/0189117 | A1 | 9/2005 | Pringle et al. | |
| 2005/0211473 | A1 | 9/2005 | Zupanick | |
| 2005/0252689 | A1 | 11/2005 | Gardes | |
| 2006/0000607 | A1 | 1/2006 | Surjaatmadja et al. | |
| 2006/0096755 | A1 | 5/2006 | Zupanick | |
| 2008/0060571 | A1 | 3/2008 | Zupanick | |
| 2008/0060799 | A1 | 3/2008 | Zupanick | |
| 2008/0060804 | A1 | 3/2008 | Zupanick | |
| 2008/0060805 | A1 | 3/2008 | Zupanick | |
| 2008/0060806 | A1 | 3/2008 | Zupanick | |
| 2008/0060807 | A1 | 3/2008 | Zupanick | |
| 2008/0066903 | A1 | 3/2008 | Zupanick | |
| 2008/0149349 | A1 | 6/2008 | Hiron et al. | |
| 2008/0245525 | A1 | 10/2008 | Rivas et al. | |
| 2009/0084534 | A1 | 4/2009 | Zupanick | |

FOREIGN PATENT DOCUMENTS

| | | | |
|---|---|---|---|
| CA | 2278735 | | 8/1998 |
| CH | 653741 | A5 | 1/1986 |
| CN | 2248254 | Y | 2/1997 |
| CN | 1174587 | A | 2/1998 |
| CN | 1191586 | | 8/1998 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | A | 10/1992 |
| GB | 2 297 988 | A | 8/1996 |
| GB | 2 347 157 | A | 8/2000 |
| RU | 2097536 | C1 | 11/1997 |
| RU | 2136566 | C1 | 9/1999 |
| RU | 2176311 | C2 | 11/2001 |
| RU | 2179234 | C1 | 2/2002 |
| RU | 2205935 | C1 | 6/2003 |
| SU | 750108 | | 6/1975 |
| SU | 876968 | | 10/1981 |
| SU | 1448078 | | 3/1987 |
| SU | 1770570 | A1 | 3/1990 |
| SU | 1709076 | A1 | 1/1992 |
| WO | WO94/21889 | | 9/1994 |
| WO | WO94/28280 | | 12/1994 |
| WO | WO97/21900 | | 6/1997 |
| WO | WO98/25005 | | 6/1998 |
| WO | WO98/35133 | | 8/1998 |
| WO | WO99/60248 | | 11/1999 |
| WO | WO 00/31376 | | 6/2000 |
| WO | WO 00/79099 | A1 | 12/2000 |
| WO | WO 01/44620 | A1 | 6/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/036023 | A1 | 5/2003 |
| WO | WO03/038233 | | 5/2003 |
| WO | WO 03/102348 | A2 | 12/2003 |
| WO | WO 2004/035984 | A1 | 4/2004 |
| WO | WO 2005/003509 | A1 | 1/2005 |
| WO | WO2005/012688 | | 2/2005 |

OTHER PUBLICATIONS

Berger, Bill, et al., "*Modern Petroleum: A Basic Primer of the Industry*," PennWell Books, 1978, Title Page, Copyright Page, and pp. 106-108 (5 pages).

Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).

Hartman, Howard L., et al., "*SME Mining Engineering Handbook*," Society for Mining, Metallurgy, and Exploration, Inc., 2nd Edition, vol. 2, 1992, Title Page, pp. 1946-1950 (6 pages).

Hassan, Dave, et al., "*Multi-Lateral Technique Lowers Drilling Costs, Provides Environmental Benefits*," Drilling Technology, Oct. 1999, pp. 41-47 (7 pages).

Ramaswamy, Gopal, "*Production History Provides CBM Insights*," Oil & Gas Journal, Apr. 2, 2001, pp. 49-50 and 52 (3 pages).

Chi, Weiguo, et al., "*Feasibility of Coalbed Methane Exploitation in China*," Horizontal Well Technology, Sep. 2001, Title Page and p. 74 (2 pages).
Nackerud Product Description, Harvest Tool Company, LLC, Received Sep. 27, 2001, 1 page.
Ramaswamy, Gopal, "*Advances Key For Coalbed Methane*," The American Oil & Gas Reporter, October 2001, Title Page and pp. 71 and 73 (3 pages).
Stevens, Joseph C., "*Horizontal Applications for Coal Bed Methane Recovery*," Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).
Eaton, Susan, "*Reversal of Fortune: Vertical and Horizontal Well Hybrid Offers Longer Field Life*," New Technology Magazine, Sep. 2002, pp. 30-31 (2 pages).
Mahony, James, "*A Shadow of Things to Come*," New Technology Magazine, Sep. 2002, pp. 28-29 (2 pages).
Documents Received from Third Party, Great Lakes Directional Drilling, Inc., Sep. 12, 2002, (12 pages).
Taylor, Robert W., et al. "*Multilateral Technologies Increase Operational Efficiencies in Middle East*," Oil and Gas Journal, Mar. 16, 1998, pp. 76-80 (5 pages).
Pasiczynk, Adam, "*Evolution Simplifies Multilateral Wells*," Directional Drilling, Jun. 2000, pp. 53-55 (3 pages).
Bell, Steven S. "*Multilateral System with Full Re-Entry Access Installed*," World Oil, Jun. 1, 1996, p. 29 (1 page).
Jackson, P., et al., "*Reducing Long Term Methane Emissions Resulting from Coal Mining*," Energy Convers. Mgmt, vol. 37, Nos. 6-8, 1996, pp. 801-806, (6 pages).
Breant, Pascal, "*Des Puits Branches, Chez Total : les puits multi drains*," Total XP-000846928, Exploration Production, Jan. 1999, 11 pages, including translation.
Chi, Weiguo, "*A feasible discussion on exploitation coalbed methane through Horizontal Network Drilling in China*," SPE 64709, Society of Petroleum Engineers (SPE International), Nov. 7, 2000, 4 pages.
B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, 10 pages.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US-03/30126 mailed Feb. 27, 2004.
Smith, Maurice, "*Chasing Unconventionally*," CBM Gas Technology, New Technology Magazine, Oct./Nov. 2003, Title Page and pp. 1-4 (5 pages).
Gardes, Robert, "*A New Direction in Coalbed Methane and Shale Gas Recovery*," believed to have been first received at The Canadian Institute Coalbed Methane Symposium conference on Jun. 17, 2002, 7 pages.
Gardes, Robert, "*Under-Balanced Multi-Lateral Drilling for Unconventional Gas Recovery*," (to the best of Applicants' recollection, first received at The Unconventional Gas Revolution conference on Dec. 9, 2003, 30 pages.
Boyce, Richard G., "*High Resolution Selsmic Imaging Programs for Coalbed Methane Development*," (to the best of Applicants' recollection, first received at The Unconventional Gas Revolution conference on Dec. 10, 2003), 28 pages.
Mazzella, Mark, et al., "*Well Control Operations on a Multiwell Platform Blowout*," WorldOil.com —Online Magazine Article, vol. 22, Part 1—pp. 1-7, Jan. 2001, and Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire*," 2000, pp. 1-17, http://www.cuddwellcontrol.com/literature/successful/successful_well.htm.
Purl, R., et al., "*Damage to Coal Permeability During Hydraulic Fracturing*," SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production*," Sep. 2003, pp. 1-100, A-1 through A-10 (123 pages).
U.S. Dept. of Energy—Office of Fossil Energy, "*Powder River Basin Coalbed Methane Development and Produced Water Management Study*," Nov. 2002, pp. 1-111, A-1 through A-14 (213).
Fletcher, Sam, "*Anadarko Cuts Route Under Canadian River Gorge*," Oil & Gas Journal, Jan. 5, 2004, pp. 28-30, (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 1997, 15 pages.
Kalinin, et al., Translation of Selected Pages from Ch. 4, Sections 4.2 (p. 135, 10.1 (p. 402), 10.4 (pp. 418-419), "*Drilling inclined and Horizontal Well Bores*," Moscow, Nedra Publishers, 1997, 4 pages.
Arens, V. Zh., Translation of Selected Pages, "*Well-Drilling Recovery of Minerals*," Moscow, Nedra Publishers, 1986, 7 pages.
Jet Lavanway Exploration, "*Well Survey*," Key Energy Surveys, Nov. 2, 1997, 3 pages.
Precision Drilling, "*We Have Roots in Coal Bed Methane Drilling*," Technology Services Group, Published on or before Aug. 5, 2002, 1 page.
U.S. Dept. of Energy, "*New Breed of CBM/CMM Recovery Technology*," Jul. 2003, 1 page.

Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.
Skrebowski, Chris, "*US Interest in North Korean Reserves*," Petroleum, Energy Institute, Jul. 2003, 4 pages.
Platt, "Method and System for Lining Multilateral Wells," S/N 10/772,841, Feb. 5, 2004 (29 pages).
Palmer, Ian D., et al., "*Coalbed Methane Well Completions and Stimulations*," Chapter 14, Hydrocarbons From Coal, American Association of Petroleum Geologists, 1993, pp. 303-339.
Field, T.W., "*Surface to In-seam Drilling—The Australian Experience*,"Undated,10 pages.
Drawings included in CBM well permit issued to CNX stamped Apr. 15, 2004 by the West Virginia Department of Environmental Protection (5 pages).
Website of Mitchell Drilling Contractors, "*Services: Dymaxion—Surface to In-seam*," http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thompson, et al., "*The Application of Medium Radius Directional Drilling for Coal Bed Methane Extraction*," Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen, "*Advanced Openhole Multilaterals*," Horizontal Wells, Nov. 2002, pp. 41-42.
Bybee, Karen, "*A New Generation Multilateral System for the Troll Olje Field*," Multilateral/Extended Reach, Jul. 2002, 2 pages.
Emerson, A.B., et al., "*Moving Toward Simpler, Highly Functional Multilateral Completions*," Technical Note, Journal of Canadian Petroleum Technology, May 2002, vol. 41, No. 5, pp. 9-12 (4 pages).
Moritis, Guntis, "*Complex Well Geometries Boost Orinoco Heavy Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269-285.
Hanes, John, "*Outbursts in Leichhardt Colliery: Lessons Learned*," International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallury & Petroleum, Paper 2002-100, to be presented in Calgary Alberta, Jun. 11-13, 2002, pp. 1-11.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*," SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Believed to be dated Apr. 1996, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/aapg/cairo2002/techprogram/paper_66806.htm, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official Newsletter of the Cooperative Research Centre for Mining Technology and Equipment, CMTE News 7, "Tight-Radius Drilling Clinches Award," Jun. 2001, 1 page.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by PennWell Publishing Company (4 pages).
"Economic Justification and Modeling of Multilateral Wells," Economic Analysis, Hart's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie-Codreanu, J.C. Sabathier and E.R. Delamide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).
H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, United States Department of the Interior, 1994 (51 pages).
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Mar. 7, 2005], http://www.worldoil.com/magazine/MAGAZINE_DETAIL.asp?ART_ID=2507@MONTH_YEAR (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Application," DOE/EIA-TR-0565, U.S. Department of Energy, Apr. 1993, 30 pages.
Santos, Helio, SPE, Impact Engineering Solutions and Jesus Olaya, Ecopetrol/ICP, "*No-Damage Drilling: How to Achieve this Challenging Goal?*," SPE 77189, Copyright 2002, presented at the IADC/SPE Asia Pacific Drilling Technology, Jakarta, Indonesia, Sep. 9-11, 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.
Robert E. Snyder, "Drilling Advances," World Oil, Oct. 2003, 1 page.
U.S. Environmental Protection Agency, "Directional Drilling Technology," prepared for the EPA by Advanced Resources International under Contract 68-W-00-094, Coalbed Methane Outreach Program (CMOP), published Dec. 2002, Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short-Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Daniel J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832.00.html, printed Apr. 14, 2005, 4 pages.
Kevin Meaney and Lincoln Paterson, "Relative Permeability in Coal," SPE 36986, Society of Petroleum Engineers, Copyright 1996, pp. 231-236.
Calendar of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.

Tom Engler and Kent Perry, "Creating a Roadmap for Unconventional Gas R&D," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol_2004/537.htm, printed Mar. 17, 2005, 7 pages.
Jeffrey R. Levine, Ph.D., "Matrix Shrinkage Coefficient," Undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.
R.W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.
Peter Jackson, "Drilling Technologies for Underground Coal Gasification," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion (7 pages) mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/033128.
Notification of Transmittal of International Preliminary Examination Report (1 page) and International Preliminary Examination Report (3 pages mailed Apr. 22, 2004 and Written Opinion (6 pages) mailed Sep. 4, 2003 for International Application No. PCT/US02/33128.
Notes on Consol Presentation (by P. Thakur) made at IOGA PA in Pittsburgh, Pennsylvania on May 22, 2002 (3 pages).
Notification of Transmittal of the International Preliminary Report of Patentability (1 page) and International Preliminary Report on Patentability (12 pages) mailed Jan. 9, 2006 for International Application No. PCT/US2004/036616.
Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application No. EP 05020737, 5 pages.
P.C. Thakur and W.N. Poundstone, "Horizontal Drilling Technology for Advance Degasification," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.
Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.
Wang Weiping, "*Trend of Drilling Technology Abroad*," Petroleum Drilling and Production Technology, 1995 (vol. 17), Issue 6, www.cnki.net, 8 pages, translation, original in Chinese.
Tver, David, *The Petroleum Dictionary*, 1980, p. 221.
Rennick, et al., "*Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.
George N. Aul and Joseph Cervik, "*Grouting Horizontal Drainage Holes in Coalbeds*," RI 8375, Bureau of Mines Report of Investigations, U.S. Department of the Interior, 1979, 21 pages.
Paul J. Componation, et al., "*Cleaning Out, Sealing and Mining Through Wells Penetrating Areas of Active Coal Mines in Northern West Virginia*," MESA Information Report 1052, U.S. Department of the Interior, 1977, 26 pages.
George S. Rice, "*Notes on the Prevention of Dust and Gas Explosions in Coal Mines*," Technical Paper 56, Bureau of Mines, Department of the Interior, copyright 1913, 12 pages.
George S. Rice, et al., "*Oil and Gas Wells Through Workable Coal Beds*," Bulletin 65, Petroleum Technology 7, Bureau of Mines, Department of the Interior, copyright 1913, 54 pages.
Notification of Transmittal of the International Preliminary Report on Patentability (1 page) and International Preliminary Report on Patentability (8 pages) for International Application No. PCT/US2005/002162 mailed May 3, 2006.
D. Nathan Meehan, "*Technology Vital For Horizontal Well Success*," Oil & Gas Journal, Dec. 11, 1995, 8 pages.
B.A. Tarr, A.F. Kuckes and M.V. Ac, "*Use of New Ranging Tool to Position a Vertical Well Adjacent to a Horizontal Well*," SPE Drilling Engineering, Jun. 1992, 7 pages.
William J. McDonald, Ph.D., John H. Cohen, and C. Mel Hightower, "*New Lightweight Fluids for Underbalanced Drilling*," believed to be on or about 1998, 10 pages.
Philip C. Crouse, "*Application and Needs for Advanced Multilateral Technologies and Strategies*," Website: www.netl.doe.gov/publications/proceedings/97/97ng/ng97_pdf/NG2-5.pdf; Believed to be on or about 1997, 9 pages.
Dan Themig, "*Multi-Laterals Providing New Options*," The American Oil & Gas Reporter, V. 39, No. 7, Jul. 1996, 4 pages.

Daniel D. Gleltman, "*Integrated Underbalance Directional Drilling System*," Interim Report for Period of Performance Oct. 1, 1995-Feb. 14, 1996, DOE FETC Contract DE-AC21-95MC31103, Mar. 1997, 23 pages.
J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.
C.A. Ehlig-Economides, G.R. Mowat and C. Corbett, "*Techniques for Multibranch Well Trajectory Design in the Context of a Three-Dimensional Reservoir Model*," SPE 35505, Society of Petroleum Engineers, Copyright 1996, 8 pages.
Stephen R. Dittoe, Albertus Retnanto, and Michael J. Economides, "*An Analysis of Reserves Enhancement in Petroleum Reservoirs with Horizontal and Multi-Lateral Wells*," SPE 37037, Society of Petroleum Engineers, Copyright 1996, 9 pages.
D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.
B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.
W.H. Leach Jr., "*New Technology for CBM Production*," Oil and Gas Investor, Opportunities in Coalbed Methane, Dec. 2002, 6 pages.
David Wagman, "*CBM Investors Keep Their Guard Up*," Oil and Gas Investor, Opportunities in Coalbed Methane, Dec. 2002, 5 pages.
Stephen D. Schwochow, "*CBM: Coming to a Basin Near You*," Oil and Gas Investor, Opportunities in Coalbed Methane, Dec. 2002, 7 pages.
"*White Paper: Guidebook on Coalbed Methane Drainage for Underground Coal Mines*," paper prepared under U.S. Environmental Protection Agency Cooperative Agreement No. CX824467-01-0 with The Pennsylvania State University by Jan M. Mutmansky, Apr. 1999, 50 pages.
M.G. Zabetakis, Maurice Deul, and M.L. Skow, "*Methane Control in United States Coal Mines—1972*," Information Circular 8600, United States Department of the Interior, Bureau of Mines Information Circular/1973, 26 pages.
B. Goktas, "*A Comparative Analysis of the Production Characteristics of Cavity Completions and Hydraulic Fractures in Coalbed Methane Reservoirs*," Society of Petroleum Engineers, SPE 55600, Copyright 1999, 10 pages.
William P. Diamond and David C. Oyler, "*Drilling Long Horizontal Coalbed Methane Drainage Holes from a Directional Surface Borehole*," Society of Petroleum Engineers, SPE/DOE 8968, 1980, 6 pages.
Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.
Patrick B. Tracy, "*Lateral Drilling Technology Tested on UCG Project*," IADC/SPE 17237, IACD/SPE Drilling Conference, Copyright 1988, 10 pages.
P.S. Sarkar and J.M. Rajtar, "*Transient Well Testing of Coalbed Methane Reservoirs With Horizontal Wells*," SPE 27681, Society of Petroleum Engineers, Copyright 1994, 9 pages.
R.A. Schraufnagel, D.G. Hill and R.A. McBane, "*Coalbed Methane—A Decade of Success*," SPE 28581, Society of Petroleum Engineers, Copyright 1994, 14 pages.
J.R. Kelafant, C.M. Boyer, and M.D. Zuber, "*Production Potential and Strategies for Coalbed Methane in the Central Appalachian Basin*," SPE 18550, Society of Petroleum Engineers, Copyright 1988, 8 pages.
Ian Palmer, John McLennan, and Mike Kutas, "*Completions and Stimulations for Coalbed Methane Wells*," SPE 30012, Society of Petroleum Engineers, Copyright 1995, 13 pages.
John E. Jochen and Bradley M. Robinson, "*Survey of Horizontal Gas Well Activity*," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.
Matt C. Rowan and Michael J. Whims, "*Multilateral Well Enhances Gas Storage Deliverability*," Oil & Gas Journal, Dec. 25, 1995, 4 pages.
Dan Thermig, "*Planning and Evaluation are Crucial to Multilateral Wells*," Petroleum Engineer International, Jan. 1996, 3 pages.
Larry Comeau, Randy Pustanyk, Ray Smith and Ian Gilles, "*Lateral Tie-Back System Increases Reservoir Exposure*," World Oil, Jul. 1995, 5 pages.
J. Smith, M.J. Economides and T.P. Frick, "*Reducing Economic Risk in Areally Anisotropic Formations With Multiple-Lateral Horizontal Wells*," SPE 30647, Society of Petroleum Engineers, Copyright 1995, 14 pages.
Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.
William P. Diamond and David C. Oyler, "*Directional Drilling for Coalbed Degasification in Advance of Mining*," Proceedings of the 2nd Annual Methane Recovery from Coalbeds Symposium, Apr. 18-20, 1979, 17 pages.
John L. Stalder, Gregory D. York, Robert J. Kopper, Carl M. Curtis and Tony L. Cole, and Jeffrey H. Copley, "*Multilateral-Horizontal Wells Increase Rate and Lower Cost Per Barrel in the Zuata Field, Faja, Venezuela*," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, and O.C. Werngren, "*Improved Recovery from Tight Gas Sands with Multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and Herbert H. Fields, "*Directionally Controlled Drilling to Horizontally Intercept Selected Strata, Upper Freeport Coalbed*, Green County, PA," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results, 1964-80*," Bureau of Mines Bulletin, Bulletin 687, 1988, 188 pages.
EPA, "*Identifying Opportunities for Methane Recovery at U.S. Coal Mines: Profiles of Selected Gassy Underground Coal Mines 1997-2001*," EPA Publication EPA 430-K-04-003, Jul. 2004, 202 pages.
Marshall DeLuca, "*Multilateral Completions on the Verge of Mainstream*," OFFSHORE, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready For More Sophisticated Multilateral Well Technology*," Petroleum Engineer International, Jan. 1996, 4 pages.
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 page.
Guntis Moritis, "*Smart, Intelligent Wells*," Oil & Gas Journal, Apr. 2, 2001, 6 pages.

Craig Couii, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a Heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.
"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (QATAR)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operator's Experience*," Synopsis of SPE 37493 by C. Ellis et al., JPT, Jul. 1997, 3 pages.
"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al., JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*," Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton, "*Use of Multi-lateral Wells to Access Marginal Reservoirs*," Offshores, Feb. 1999, 3 pages.
J.R. Salas, P.J. Clifford and D.P. Jenkins, "*Brief: Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and Kim Jones, "*How ARCO Drills High-Angle Wells Offshore Indonesia*," World Oil, Mar. 1993, 11 pages.
S. Hovda, et al., "*World's First Application of a Multilateral System Combining a Cased and Cemented Junction With Fullbore Access to Both Laterals*," SPE 36488, Society of Petroleum Engineers, Copyright 1996, 15 pages.
Robert A. Gardes, "*Micro-annulus Under-balanced Drilling of Multilateral Wells*," Offshore, May 1996, 4 pages.
Brent Lowson, "*Phillips Multilateral Features Several Firsts for North Sea*," Offshore, Feb. 1997, 2 pages.
J.R. Scofield, B. Laney and P. Woodard, "*Field Experience With Multi-Laterals in the Idd El Shargi North Dome Field.(Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," Offshore, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal of Canadian Petroleum Technology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.
Cliff Hogg, "*Comparison of Multilateral Completion Scenarios and Their Application*," SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.
H. Azoba, O. Akinmolandun, H. Rothenhofer, D. Kent and N. Nawfal, "*World Record Dual- and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.
D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed*, Alabama, *Using Horizontal Drilling Techniques*," SPE/DOE 8967, Society of Petroleum Engineers, May 18, 1980, 6 pages.
Gerald L. Finfinger, Leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," RI 8097, Bureau of Mines Reporting of Investigations, 1975, 26 pages.
D.G. Masszi and A.A. Kahil, "*Coal Demethanation Principles and Field Experience*," The Journal of Canadian Petroleum Technology, Jul.-Aug. 1982, 4 pages.
Tobias W. Goodman, Joseph Cervik, and George N. Aul, "*Degasification Study From an Air Shaft in the Beckley Coalbed*," RI 8675, Bureau of Mines Report of Investigations, 1982, 23 pages.
P.C. Thakur and H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State of the Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face*," Preprint No. 83-398, Society of Mining Engineers of AIME, for presentation at the SME-AIME Fall Meeting and Exhibit, Salt Lake City, Utah, Oct. 19, 21, 1983, 14 pages.

Warren F. Dobson and Daniel R. Seelye, "*Mining Technology Assists Oil Recovery from Wyoming Field*," SPE 9418, Society of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery*," SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*," SPE 37131, Society of Petroleum Engineers, Copyright 1996, 13 pages.
S.D. Joshi, "*A Review of Horizontal Well and Drainhole Technology*," SPE 16868, Society of Petroleum Engineers, Copyright 1987, 17 pages.
R. Bitto, A.B. Henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385, Society of Petroleum Engineers, Copyright 1996, 11 pages.
Kelly Falk and Craig McDonald, "*An Overview of Underbalanced Drilling Applications in Canada*," SPE 30129, Society of Petroleum Engineers, Copyright 1995, 9 pages.
"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," OFFSHORE, Jul. 1997, 6 pages.
"*Trilateral Horizontal Wells Add 10 Million bbl for Unocal*," OFFSHORE, Dec. 1993, 2 pages.
Nicholas P. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan, "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From Horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Margaret A. Adams, Jeanne L. Hewitt and Rodney D. Malone, "*Coalbed Methane Potential of the Appalachians*," SPE/DOE 10802, Society of Petroleum Engineers, Copyright 1982,10 pages.
F.C. Schwerer and A.M. Pavone, "*Effect of Pressure-Dependent Permeability on Well-Test Analyses and Long-Term Production of Methane From Coal Seams*," SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*," RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "*Elf Drills 1,000+Ft Horizontally*," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based on Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.
D. Keith Murray, "*Deep Coals Hold Big Part of Resource*," The American Oil & Gas Reporter, May 2002, 8 pages.
Nestor Rivera, et al., "*Multilateral, Intelligent Well Completion Benefits Explored*," Oil & Gas Journal, Apr. 14, 2003, 10 pages.
Handbook on Coal Bed Methane Produced Water: Management and Beneficial Use Alternatives, prepared by ALL Consulting, Jul. 2003, 321 pages.
Nikola Maricic, "*Parametric and Predictive Analysis of Horizontal Well Configurations for Coalbed Methane Reservoirs in Appalachian Basin*," Thesis, West Virginia University, Department of Petroleum and Natural Gas Engineering, 2004, 162 pages.
Nikola Maricic, Shahab D. Mohaghegh, and Emre Artun, "*A Parametric Study on the Benefits of Drilling Horizontal and Multilateral Wells in Coalbed Methane Reservoirs*," SPE 96018, Society of Petroleum Engineers, Copyright 2005, 8 pages.
D.P. Schlick and J.W. Stevenson, "*Methane Degasification Experience at Jim Walter's*," Proceedings of the Twelfth Annual Institute on Coal Mining Health, Safety and Research, Aug. 25-27, 1981, 9 pages.
P.C. Thakur, "*Optimum Methane Drainage in Gassy Coal Mines*," 2003 SME Annual Meeting, copyright 2003 by SME, 4 pages.
Global Methane and the Coal Industry: A Two-Part Report on Methane Emissions from the Coal Industry and Coalbed Methane Recovery and Use, Coal Industry Advisory Board, International Energy Agency, copyright 1994, 72 pages.
Michael Schumacher, AKZO Salt Inc., Solution Mining in the Nineties, believed to be in Dec. 2005, 8 pages.
Pratt et al., U.S. Patent Application entitled "Cavity Well System," U.S. Appl. No. 11/141,335, May 31, 2005, 19 pages.
Michael Schumacher, Akzo Salt, Inc., et al., "Solution Mining in the Nineties," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages) and Amended Sheets (9 pages) for International Application No. PCT/US2004/012029 mailed Aug. 11, 2005.
Chase, Robert William, "*Degasification of Coal Seams Via Vertical Boreholes: A Field and Computer Simulation Study*," Thesis in Petroleum and Natural Gas Engineering, Mar. 1980, 174 pages.
Coal-Bed Methane: Potential and Concerns, U.S. Department of the Interior, U.S. Geological Survey, USGS Fact Sheet FS-123-00, Oct. 2000, 2 pages.
Horizontal and Multilateral Wells, Society of Petroleum Engineers, website: http://www.spe.org/spe/jsp/basic_pf/0 . . . 1104_1714 1003974.00.html, printed Dec. 27, 2006, 5 pages.
Kalinin, A. G. et al., "*Boring of Slanted and Horizontal Well Bores*," Moskva, Nedra, 1997, pp. 453-458, Sections 11.2, 11.2.2, and 11.2.3, 10 pages.
Kalinin, D. G. et al., Translation of Selected Pages, "Boring Direction and Horizontal Wells," Moscow, "Nedra", 1997, p. 11-12, 148-152 (15 pages).
Lindblom, S. R. and V. E. Smith, "Rocky Mountain 1 Underground Coal Gasification Test," Hanna, Wyoming, Groundwater Evaluation, DOE Grant No. De-FG21-88MC25038, Final Report, Jun. 10, 1988-Jun. 30, 1993, 5 pages.
Logan, Terry L., "Application of Medium Radius Horizontal Drainhole Drilling Technology for Underground Coal Gasification," presented at 13th Annual Underground Coal Gasification Symposium, Aug. 24-26, 1987, Laramie, Wyoming, 10 pages.

Evaluation of Coalbed Methane Well Types in the San Juan Basin, prepared by Malkewicz Hueni Associates, Inc. For the Bureau of Land Management, Mar. 2004, 23 pages.
Orlov, V. S. et al., "*Methods for Simultaneous Segregated Production from Multiple Formations Using Single Well*," Series Petroleum Engineering, Moscow, Aurdiomeogi, 1976, translated pp. 6-11, 28-29 and 36-37, 15 pages.
Palmer, I. D., M. J. Mayor, J. L. Spitler and R. F. Volz, "*Openhole Cavity Completions in Coalbed Methane Wells in the San Juan Basin*," Journal of Petroleum Technology, vol. 45, No. 11, Nov. 1993, 11 pages.
Shuck, L. Z. and J. Pasini III, "In Situ Gasification of Eastern Coals," presented at the Proceedings of the Coal Processing and Conversion Symposium, Jun. 1-3, 1976, Morgantown, West Virginia, 16 pages.
Notification of Transmittal of the International Search Report and the Written Opinion of the International Searching Authority, or the Declaration (3 pages), International Search Report (7 pages), and Written Opinion of the International Searching Authority (7 pages) for International Application No. PCT/US2006/021057 dated Jan. 4, 2007.
Invitation to Pay Additional Fees (2 pages) and Annex to Form PCT/ISA/206 Communication Relating to the Results of the Partial International Search (3 pages) for International Application No. PCT/US2006/021057 mailed Sep. 11, 2006.
Notification Concerning Transmittal of Copy of International Preliminary Report on Patentability (1 page), International Preliminary Report on Patentability (1 page), and Written Opinion (5 pages) for International Application No. PCT/US2005/005289 mailed Sep. 8, 2006.
Notification of Transmittal of the International Preliminary Report on Patentability (1 page) and International Preliminary Report on Patentability (10 pages) for International Application No. PCT/US2006/021057 mailed Jul. 9, 2007.
William P. Diamond and David C. Oyler, "Effects of Stimulation Treatments on Coalbeds and Surrounding Strata: Evidence From Underground Observations," RI 9083, Bureau of Mines Report of Investigations, 1987 (53 pages).
W.P. Diamond and D.C. Oyler, "Recent Underground Observations of Intercepted Hydraulic Stimulations in Coalbed Methane Drainage Wells," Preprint No. 85-332, Society of Mining Engineers of AIME, SME-AIME Fall Meeting, Oct. 16-18, 1985 (12 pages).
William P. Diamond, "Underground Observations of Mined-Through Stimulation Treatments of Coalbeds," Methane From Coal Seams Technology, Jun. 1987 (11 pages).
W.P. Diamond, "Characterization of Fracture Geometry and Roof Penetrations Associated with Stimulation Treatments in Coalbeds," 1987 Coalbed Methane Symposium, Nov. 16-19, 1987 (11 pages).
C.M. McCulloch, Maurice Deul and P.W. Jeran, "Cleat in Bituminous Coalbeds," RI 7910, Bureau of Mines Report of Investigations, 1974 (28 pages).
B.E. Law, "The Relationship Between Coal Rank and Cleat Spacing: Implications for the Prediction of Permeability in Coal," Proceedings of the 1993 International Coalbed Methane Symposium, May 17-21, 1993 (7 pages).
C.T. Montgomery and R.E. Steanson, "Proppant Selection: The Key to Successful Fracture Stimulation," Journal of Petroleum Technology, Dec. 1985 (10 pages).
R.W. Veatch, Jr., "Overview of Current Hydraulic Fracturing Design and Treatment Technology—Part 2," Journal of Petroleum Technology, May 1983 (12 pages).
David D. Cramer, "The Unique Aspects of Fracturing Western U.S. Coalbeds," Journal of Petroleum Technology, Oct. 1992 (8 pages).
S.A. Holditch, J.W. Ely, R.H. Carter, and M.E. Semmelbeck, Coal Seam Stimulation Manual, Gas Research Institute, Contract No. 5087-214-1469, Apr. 1990 (265 pages).
Jack E. Nolde, "Coalbed Methane in Virginia," Virginia Minerals, Virginia Division of Mineral Resources, vol. 41, Feb. 1995 (7 pages).
C.H. Elder and Maurice Deul, "Degasification of the Mary Lee Coalbed Near Oak Grove, Jefferson County, Ala., by Vertical Borehole in Advance of Mining," RI 7968, U.S. Bureau of Mines, 1974 (23 pages).
Maureen Lorenzetti, "Policymakers eye frac regulation to protect groundwater," Oil & Gas Journal, Sep. 10, 2001, p. 40 (1 page).
Peter F. Steidl, "Foam Stimulation to Enhance Production From Degasification Wells in the Pittsburgh Coalbed," RI 8286, Bureau of Mines Report of Investigations, 1978 (11 pages).
David G. Hill, "Contribution of Unconventional Gas to U.S. Supply Continues to Grow," Gas Research Institute Gas TIPS, Fall 2001 (6 pages).
Vello A. Kuuskraa and Charles F. Brandenburg, "Coalbed Methane Sparks a New Energy Industry," Oil & Gas Journal, Week of Oct. 9, 1989 (8 pages).
Walter B. Ayers Jr. and Bruce S. Kelso, "Knowledge of Methane Potential for Coalbed Resources Grows, But Needs More Study," Oil & Gas Journal, Oct. 23, 1989 (6 pages).
John E. McElhiney, Robert A. Koenig and Richard A. Schraufnagel, "Evaluation of Coalbed-Methane Reserves Involves Different Techniques," Oil & Gas Journal, Week of Oct. 9, 1989 (8 pages).
Steven W. Lambert, Stanley L. Graves and Arfon H. Jones, "Warrior Basin Drilling, Stimulation Covered," Oil & Gas Journal, Week of Oct. 9, 1989 (7 pages).
Steven W. Lambert and Stanley L. Graves, "Production Strategy Developed," Oil & Gas Journal, Week of Oct. 9, 1989 (4 pages).
Terry L. Logan, Western Basins Dictate Varied Operations, Oil & Gas Journal, Week of Oct. 9, 1989 (7 pages).
Vello A. Kuuskra, Charles M. Boyer II, and Richard A. McBane, "Steps to Assess Resource Economics Covered," Oil & Gas Journal, Week of Oct. 9, 1989 (6 pages).
Richard A. Counts, "Ownership Questions Can Stymie Development of Coalbed Methane," Oil & Gas Journal, Week of Oct. 9, 1989 (6 pages).
Richard A. Schraufnagel, Richard A. McBane and Vello A. Kuuskraa, "Coalbed Methane Development Faces Technology Gaps," Oil & Gas Journal, Week of Oct. 9, 1989 (7 pages.
"US Coalbed Methane Resource Estimates, Issues Aired," Oil & Gas Journal, Sep. 24, 2001 (2 pages).
Dr. Charles R. Nelson, "Coalbed Methane Potential of the U.S. Rocky Mountain Region," Gas TIPS, Fall 2000 (9 pages).
Dr. Charles R. Nelson, "Changing Perceptions Regarding the Size and Production Potential of Coalbed Methane Resources," Gas TIPS, Summer 1999 (9 pages).
Ala. Coalbed Methane Production Hits Record, Coal Age, May 1998 (1 page).
Charles M. Boyer II, "Introduction," Gas Research Institute, Methane From Coal Seams Technology, Aug. 1993 (4 pages).
P.F. Steidl, "Evaluation of Induced Fractures Intercepted by Mining," Proceedings of the 1993 International Coalbed Methane Symposium, May 17-21, 1993 (12 pages).
W.P. Diamond, W.R. Bodden III, M.D. Zuber and R.A. Schraufnagel, "Measuring the Extent of Coalbed Gas Drainage After 10 Years of Production at the Oak Grove Pattern, Alabama," Proceedings of the 1989 Coalbed Methane Symposium, Apr. 17-20, 1989 (10 pages).
W.M. Merritts, W.N. Poundstone and B.A. Light, "Removing Methane (Degasification) From the Pittsburgh Coalbed in Northern West Virginia," Bureau of Mines RI 5977, 1962 (46 pages.
M.L. Skow, Ann G. Kim and Maurice Deul, "Creating a Safer Environment in U.S. Coal Mines," U.S. Bureau of Mines Impact Report, 1980 (56 pages).
Stephen W. Lambert, Michael A. Trevits, and Peter F. Steidl, "Vertical Borehole Design and Completion Practices Used to Remove Methane Gas From Mineable Coalbeds," U.S. Dept. Of Energy, 1980 (173 pages).
M.A. Trevits, S.W. Lambert, P.F. Steidl and C.H. Elder, "Methane Drainage Through Small-Diameter Vertical Boreholes," Chapter 9 in U.S. Bureau of Mines Bulletin B687 entitled Methane Control Research: Summary of Results, 1964-80, 1988 (25 pages).
C.M. Boyer II and S.R. Reeves, "A Strategy for Coalbed Methane Production Development Part III: Production Operations," Proceedings of the 1989 Coalbed Methane Symposium, Apr. 17-20, 1989 (5 pages).
R.A. Mills and J.W. Stevenson, "History of Methane Drainage at Jim Walter Resources, Inc.," Proceedings of the 1991 Coalbed Methane Symposium, May 13-16, 1991 (9 pages).
Richard A. Schraufnagel, "Coalbed Methane Production," Chapter 15 of Hydrocarbons from Coal, American Association of Petroleum Geologists, 1993 (21 pages).

Curtis H. Elder, "Effects of Hydraulic Stimulation on Coalbeds and Associated Strata," Bureau of Mines RI 8260, 1977 (25 pages).
A Guide to Coalbed Methane Reservoir Engineering, published by Gas Research Institute, GRI-94/0397, pp. 2.11-2.12, 1996 (3 pages).
Well Performance Manual, Schlumberger, pp. 3-1 and 3-2, Aug. 1993 (4 pages).
Michael Zuber, "Coalbed Methane Engineering Methods," The Society of Petroleum Engineers, Oct. 2006 (161 pages).
James V. Mahoney, P.B. Stubbs, F.C. Schwerer III and F.X. Dobscha, "Effects of a No-Proppant Foam Stimulation Treatment on a Coal-Seam Degasification Borehole," Journal of Petroleum Technology, Nov. 1981 (9 pages).
S.J. Jeu, T.L. Logan and R.A. McBane, "Exploitation of Deeply Buried Coalbed Methane Using Different Hydraulic Fracturing Techniques in the Piceance Basin, Colorado and San Juan Basin New Mexico," Society of Petroleum Engineers, SPE 18253, copyright 1988 (11 pages).
Stephen E. Laubach, Carol M. Tremain and Walter B. Ayers, Jr., "Coal Fracture Studies: Guides for Coalbed Methane Exploration and Development," Journal of Coal Quality, vol. 10, No. 3, Jul.-Sep. 1991 (8 pages).
*CNX Gas Corporation, et al.* v. *CDX Gas, LLC*, United States District Court, Western District of Pennsylvania (Pittsburgh), Civil Action No. 2:05-CV-1574-AJS, Civil Docket as of Oct. 24, 2007, 54 pages.
*CNX Gas Corporation, et al.* v. *CDX Gas, LLC*, United States District Court, Western District of Pennsylvania, Civil Action No. 05-Cv-1574, Parties' Complaints and Answers, including Claims, Counterclaims and Affirmative Defenses, earliest dated Nov. 14, 2005, 506 pages.
*CNX Gas Corporation, et al.* v. *CDX Gas, LLC*, United States District Court, Western District of Pennsylvania, Civil Action No. 05-CV-1574, Parties' Filings on Claim Construction and Adopting Report and FRecommendation of special Master, including Briefs, Exhibits, Motions and Proposed Orders, earliest dated Mar. 16, 2006, 1,532 pages.
*CNX Gas Corporation, et al.* v. *CDX Gas, LLC*, United States District Court, Western District of Pennsylvania, Civil Action No. 05-CV-1574, Report and Recommendation and Order of Special Master, earliest dated Aug. 30, 2006, 28 pages, and Order of Court adopting report and recommendation of the Special Master as the opinion of the court, dated Oct. 13, 2006, 2 pages.
*CNX Gas Corporation, et al.* v. *CDX Gas, LLC*, United States District Court, Western District of Pennsylvania, Civil Action No. 05-CV-1574, Parties' Summary Judgment Filings on Entitlement of Asserted Claims of Patents-in-Suit to the Filing Date of '000 Patent, including Briefs, Exhibits, Motions, Proposed Orders and Statements of Undisputed Material Facts, earliest dated Jan. 5, 2007, 644 pages.
*CNX Gas Corporation, et al.* v. *CDX Gas, LLC*, United States District Court, Western District of Pennsylvania, Civil Action No. 05-CV-1574, Memorandum Opinion and Order of Court Re: Cross Motions for Partial Summary Judgment—Finding that the Asserted Claims of the Patent-in-Suit are Entitled to the filed of the '000 Patent and Order of Court, earliest dated Feb. 20, 2007, 4 pages.
*CNX Gas Corporiaion, et al.* v. *CDX Gas, LLC*, United States District Court, Western District of Pennsylvania, Civil Action No. 05-CV-1574, Parties' Discovery Responses, including Response's to Interrogatories and Responses to Requests for Admissions, earliest dated Jan. 18, 2006, 177 pages.
*CNX Gas Corporation, et al.* v. *CDX Gas, LLC*, United States District Court, Western District of Pennsylvania, Civil Action No. 05-CV-1574, Plaintiffs' Non-Infringement and Invalidity Contention Pursuant to LPR 3.4, including Attachment a with all Supplemental and updated Attachment A, dated Jan. 30, 2006, 934 pages.
Dreiling, Tim, McClelland, M.L., and Bilyeu, Brad, "Horizontal and High Angle Drilling in the San Juan Basin, New Mexico," The Brief, published by Amoco and Chevron by Murphy Publishing, Inc., vol. 2, Issue 6, No. 54, Jun. 1996 (9 pages).
T. Beims and C. Strunk, "*Capital, Technology Suppliers Pulling New Tricks From The Hat As Industry Hits High Gear*," The American Oil & Gas Reporter, Mar. 1997 (8 pages).
B. Campbell, "*Directional Driller Discovers Future in Technology*," The American Oil & Gas Reporter, Jul. 1991 (4 pages).
"*Economic Justification and Modeling of Multilateral Wells*," in "Multilateral Technology: Taking Horizontal Wells to the Next Level"—a supplement to Hart's Petroleum Engineer, International, 1997 (5 pages).
R. Gardes, "*New Radial Drilling Technology Applied to Recovering Cores*," The American Oil & Gas Reporter, Apr. 1993 (5 pages).
Gardes Energy Services, Inc., Map of Drilled Well Locations (1 page), undated.
"*Gardes Drilling redefines improved recovery*," Improved Recovery Week, vol. 1, Jul. 1992 (3 pages).
R. Gardes, "*Micro-Annulus Underbalanced Drilling of Multilaterals*," 4th Annual North American Conference on Coiled Tubing, Feb. 5-6, 1996 (23 pages).
R. Gardes, "*The Evolution of Horizontal Multi-Lateral Underbalanced Drilling Technology*," Society of Independent Professional Earth Scientists Newsletter, vol. 38, Aug. 2000 (3 pages).
R. Gardes, *Underbalanced Drilling of Multilateral Horizontal Wells*, 8th Annual International Conference on Horizontal Well Technologies & Applications, Sep. 9-11, 1996 (7 pages).
"*Lafayette firm set to do business with Soviet Union*," Advertiser, Lafayette, LA, Aug. 1990 (1 page).
L. LeBlanc, "*Beyond extended-read, horizontal drilling?*," Drilling & Production, May 1992 (1 page).
"*Local firm signs contract to develop Soviet fields*," the Daily Advertiser, Dec. (1 page), no year.
"*History Repeats Itself: Multilateral Technology Development Parallels That of Horizontal Wells*," in "Multilateral Technology: Taking Horizontal Wells to the Next Level"—a supplement to Hart's Petroleum Engineer International, (5 pages), undated.
"*New Enabling Technologies Spur Multilateral Use*," in "Multilateral Technology: Taking Horizontal Wells to the Next Level"—a supplement to Hart's Petroleum Engineer International, (5 pages), undated.
"*New tools, techniques reduce high-angle drilling costs*," Offshore, Nov. 1989 (3 pages).
R. Gardes, "*Micro-annulus under-balanced drilling of multilateral wells*," Offshore, May 1996 (4 pages).
"*Multiple directional wells from single borehole developed*," Offshore, reprint from Jul. 1989 (4 pages).
"*Soviet joint venture pace continues to sizzle*," Oil & Gas Journal, week of Jun. 25, 1990 (3 pages).
"*Operators Team Up to Climb Learning Curve Together*," in "Multilateral Technology: Taking Horizontal Wells to the Next Level"—a supplement to Hart's Petroleum Engineer International (4 pages), undated.
"*Radial Coring Reduces Sample Contamination, Evaluates Old Wells*," Hart's Petroleum Engineer International, Jun. 1994 (4 pages).
"*The Fate of Award Winners Is a Credit to Their Judges*," Hart's Petroleum Engineer International, Apr. 1996 (3 pages).
S. R. Reeves and S. H. Stevens, "*$CO_2$ Sequestration*," World Coal, Dec. 2000 (4 pages).
"*Successful Completions Raise Operators' Confidence*," in "Multilateral Technology: Taking Horizontal Wells to the Next Level"—a supplement to Hart's Petroleum Engineer International (5 pages), undated.
File "CDX" received from Cliffs Natural Resources on or about Feb. 2009 relating to past activities as noted by the dates provided on various documents therein. CNR000001. (314 pages).
File "DW-9" received from Cliffs Natural Resources on or about Feb. 2009 relating to past activities as noted by the dates provided on various documents therein. CNR000308. (372 pages).
File "DW-10" received from Cliffs Natural Resources on or about Feb. 2009 relating to past activities as noted by the dates provided on various documents therein. CNR000673. (7 pages).
File "DW12" received from Cliffs Natural Resources on or about Feb. 2009 relating to past activities as noted by the dates provided on various documents therein. CNR000680. (242 pages).
File "DW-14" received from Cliffs Natural Resources on or about Feb. 2009 relating to past activities as noted by the dates provided on various documents therein. CNR000922. (162 pages).
File "Mine Thru Holes" received from Cliffs Natural Resources on or about Feb. 2009 relating to past activities as noted by the dates provided on various documents therein. CNR001083. (293 pages).

File "8G-3" received from Cliffs Natural Resources on or about Feb. 2009 relating to past activities as noted by the dates provided on various documents therein. CNR001376. (219 pages).
File "Pumping Units Horsehead type" received from Cliffs Natural Resources on or about Feb. 2009 relating to past activities as noted by the dates provided on various documents therein. CNR001586. (12 pages).
File "8F-4" received from Cliffs Natural Resources on or about Feb. 2009 relating to past activities as noted by the dates provided on various documents therein. CNR001598. (255 pages).
File "8G-1" received from Cliffs Natural Resources on or about Feb. 2009 relating to past activities as noted by the dates provided on various documents therein. CNR001852. (145 pages).
File "Directional Drilling" received from Cliffs Natural Resources on or about Feb. 2009 relating to past activities as noted by the dates provided on various documents therein. CNR001993. (371 pages).
File "Gas Sales CNG" received from Cliffs Natural Resources on or about Feb. 2009 relating to past activities as noted by the dates provided on various documents therein. CNR002364. (402 pages).
File "CDX—Jun. 2, 1998 2nd drill arrangement" received from Cliffs Natural Resources on or about Feb. 2009 relating to past activities as noted by the dates provided on various documents therein. CNR002766. (51 pages).
File "HoriZontal Degas—Color Charts of Degasification Rates" received from Cliffs Natural Resources on or about Feb. 2009 relating to past activities as noted by the dates provided on various documents therein. CNR002817. (8 pages).
File "Gas Sales vol. And Revenue 1997—CDX Weekly Summary" received from Cliffs Natural Resources on or about Feb. 2009 relating to past activities as noted by the dates provided on various documents therein. CNR002825. (63 pages).
File "DW6 & 9 Proposals" received from Cliffs Natural Resources on or about Feb. 2009 relating to past activities as noted by the dates provided on various documents therein. CNR002914. (25 pages).
File "CDX" received from Cliffs Natural Resources on or about Feb. 2009 relating to past activities as noted by the dates provided on various documents therein. CNR002939. (183 pages).
File "CDX Lease & Invoicing" received from Cliffs Natural Resources on or about Feb. 2009 relating to past activities as noted by the dates provided on various documents therein. CNR003121. (77 pages).
File "Gas Sales CDX 1999" received from Cliffs Natural Resources on or about Feb. 2009 relating to past activities as noted by the dates provided on various documents therein. CNR003198. (436 pages).
Compilation of various other documents received from Cliffs Natural Resources on or about Feb. 2009. CNR002888-2913. CNR003634-CNR003769. CNR003800. CNR010737. (168 pages).
"Methane Gas Lease and Development Agreement by and between U.S. Steel Mining Company, LLC Lessor and CDX Gas, LLC Lessee" entered into on Dec. 31, 1997. CNR003770. (30 pages).
File "8A Articulated Drilling 8B" received from Cliffs Natural Resources on or about Feb. 2009 relating to past activities as noted by the dates provided on various documents therein. CNR003801. (51 pages).
File "U.S. Mining Pinnacle Mine CBM Well #10" received from Cliffs Natural Resources on or about Feb. 2009 relating to past activities as noted by the dates provided on various documents therein. CNR003852. (47 pages).
File "CDX 7P-1 Well Application" received from Cliffs Natural Resources on or about Feb. 2009 relating to past activities as noted by the dates provided on various documents therein. CNR003899. (17 pages).
File "8E-1 Articulated Drilling Plan" received from Cliffs Natural Resources on or about Feb. 2009 relating to past activities as noted by the dates provided on various documents therein. CNR003916. (10 pages).
File "CDX—Aug. 31, 1998 Proposal" received from Cliffs Natural Resources on or about Feb. 2009 relating to past activities as noted by the dates provided on various documents therein. CNR003926. (20 pages).
File "CDX JDMC File" received from Cliffs Natural Resources on or about Feb. 2009 relating to past activities as noted by the dates provided on various documents therein. CNR003946. (85 pages).
File "Facility Plan" received from Cliffs Natural Resources on or about Feb. 2009 relating to past activities as noted by the dates provided on various documents therein. CNR004031. (7 pages).
File "Artic DW History" received from Cliffs Natural Resources on or about Feb. 2009 relating to past activities as noted by the dates provided on various documents therein. CNR004036. (40 pages).
File "Degas Meeting Notes" received from Cliffs Natural Resources on or about Feb. 2009 relating to past activities as noted by the dates provided on various documents therein. CNR004075. (85 pages).
File "AMT" received from Cliffs Natural Resources on or about Feb. 2009 relating to past activities as noted by the dates provided on various documents therein. CNR004160. (262 pages).
File "MSHA Plan" received from Cliffs Natural Resources on or about Feb. 2009 relating to past activities as noted by the dates provided on various documents therein. CNR004421. (316 pages).
File "Horiz. Degas Prod. 1997-1998" received from Cliffs Natural Resources on or about Feb. 2009 relating to past activities as noted by the dates provided on various documents therein. CNR004737. (165 pages).
File "DW-1" received from Cliffs Natural Resources on or about Feb. 2009 relating to past activities as noted by the dates provided on various documents therein. CNR004902. (225 pages).
File "DW-2" received from Cliffs Natural Resources on or about Feb. 2009 relating to past activities as noted by the dates provided on various documents therein. CNR005126. (702 pages).
File "8F-1" received from Cliffs Natural Resources on or about Feb. 2009 relating to past activities as noted by the dates provided on various documents therein. CNR005825. (228 pages).
File "8E-1 DW" received from Cliffs Natural Resources on or about Feb. 2009 relating to past activities as noted by the dates provided on various documents therein. CNR006051. (248 pages).
File "8E-4" received from Cliffs Natural Resources on or about Feb. 2009 relating to past activities as noted by the dates provided on various documents therein. CNR006299. (232 pages).
File "8S-4 ABC" received from Cliffs Natural Resources on or about Feb. 2009 relating to past activities as noted by the dates provided on various documents therein. CNR006528. (222 pages).
File "Cement Holes" received from Cliffs Natural Resources on or about Feb. 2009 relating to past activities as noted by the dates provided on various documents therein. CNR006743. (301 pages).
File "8F-3" received from Cliffs Natural Resources on or about Feb. 2009 relating to past activities as noted by the dates provided on various documents therein. CNR007043. (308 pages).
File "Horizontal Degasification" received from Cliffs Natural Resources on or about Feb. 2009 relating to past activities as noted by the dates provided on various documents therein. CNR007349. (263 pages).
File "DW-3" received from Cliffs Natural Resources on or about Feb. 2009 relating to past activities as noted by the dates provided on various documents therein. CNR007609. (268 pages).
File "DW-4" received from Cliffs Natural Resources on or about Feb. 2009 relating to past activities as noted by the dates provided on various documents therein. CNR007876. (360 pages).
File "DW-5" received from Cliffs Natural Resources on or about Feb. 2009 relating to past activities as noted by the dates provided on various documents therein. CNR008236. (248 pages).
File "DW-6" received from Cliffs Natural Resources on or about Feb. 2009 relating to past activities as noted by the dates provided on various documents therein. CNR008484. (318 pages).
File "DW-7" received from Cliffs Natural Resources on or about Feb. 2009 relating to past activities as noted by the dates provided on various documents therein. CNR008801. (298 pages).
File "8F-2" received from Cliffs Natural Resources on or about Feb. 2009 relating to past activities as noted by the dates provided on various documents therein. CNR009098. (548 pages).
File "8G-2" received from Cliffs Natural Resources on or about Feb. 2009 relating to past activities as noted by the dates provided on various documents therein. CNR009642. (202 pages).
File "Hazard '97" received from Cliffs Natural Resources on or about Feb. 2009 relating to past activities as noted by the dates provided on various documents therein. CNR009840. (234 pages).

File "CDX Final Invoices" received from Cliffs Natural Resources on or about Feb. 2009 relating to past activities as noted by the dates provided on various documents therein. CNR010074. (295 pages).
File "8FG1.5" received from Cliffs Natural Resources on or about Feb. 2009 relating to past activities as noted by the dates provided on various documents therein. CNR010369. (175 pages).
File "CBM Tech" received from Cliffs Natural Resources on or about Feb. 2009 relating to past activities as noted by the dates provided on various documents therein. CNR010537. (141 pages).
File "Mine Thru—Long Holes" received from Cliffs Natural Resources on or about Feb. 2009 relating to past activities as noted by the dates provided on various documents therein. CNR010678. (59 pages).
File "Gas Sales Cabot" received from Cliffs Natural Resources on or about Feb. 2009 relating to past activities as noted by the dates provided on various documents therein. CNR010738. (267 pages).
Johnson et al., "Underbalanced Drilling Design Maximizes Coal Bed Methane Recoveries", CDX Gas, Aug. 2008 (6 pages).
Morrish, Susan, "Communication of Partial European Search Report", European Patent Office, Application No. EP 07 02 1409, Aug. 6, 2008 (6 pages).
Morrish, Susan, "Communication of European Search Report", European Patent Office, Application No. EP 07 02 1409, Oct. 30, 2008 (8 pages).
Website: http://biz.yahoo.com/bw/080602/20080602006520.html?.v=1&printer=1, Press Release, CDX Gas Settles Patent Litigation With CNX Gas, Monday, Jun. 2, 2008, 5:00 p.m. ET, printed Jun. 4, 2008 (2 pages).
The State Intellectual Property Office of the People's Republic of China, "Third Office Action", Application No. 200710152916.9, issued on Aug. 1, 2012 (4 pages).
The State Intellectual Property Office of the People's Republic of China, "The First Office Action", Chinese Appl. No. 99815570.5, dated Apr. 29, 2005 (6 pages).
Lili Xuan, "The First Office Action", Chinese Appl. No. 200880023608.9, dated Apr. 20, 2012 (11 pages).
Ron Weber, "Examination Report", Australian Appl. No. 2011200364, dated Dec. 22, 2011 (2 pages).
Jeffrey Butler, "Examination Report", Canadian Appl. No. 2,661,725, dated Jun. 6, 2011 (3 pages).
Fedorova, T., "English translation of Office Action", Russian Appl. No. 2008-143916, issued on Feb. 7, 2013 (5 pages).
Kalinin, A.G., et al. "English translation of Drilling of Slanted and Horizontal Wells", pp. 5-8, 141, 150, 159, and 467-470 (1997) (14 pages).
Vadetsky, "English translation of Drilling of Oil and Gas Wells", pp. 215-216 (1985) (6 pages).

* cited by examiner

METHOD AND SYSTEM FOR CIRCULATING FLUID IN A WELL SYSTEM

RELATED APPLICATIONS

This application is a divisional application of U.S. application Ser. No. 10/323,192 filed Dec. 18, 2002 now U.S. Pat. No. 7,025,154 which is a continuation-in-part of U.S. application Ser. No. 09/788,897 U.S. Pat. No. 6,732,792 filed Feb. 20, 2001 by Joseph A. Zupanick entitled Multi-Well Structure for Accessing Subterranean Deposits, which is a divisional application of application Ser. No. 09/444,029, now U.S. Pat. No. 6,357,523 filed Nov. 19, 1999, entitled Drainage Pattern With Intersecting Wells Drilled From Surface, which is a continuation-in-part application of application Ser. No. 09/197,687 now U.S. Pat. No. 6,280,000 filed Nov. 20, 1998, entitled Method for Production of Gas from a Coal Seam Using Intersecting Well Bores.

TECHNICAL FIELD OF THE INVENTION

The present invention relates generally to systems and methods for the recovery of subterranean resources and, more particularly, to a method and system for circulating fluid in a well system.

BACKGROUND OF THE INVENTION

Subterranean deposits of coal, also referred to as coal seams, contain substantial quantities of entrained methane gas. Production and use of methane gas from coal deposits has occurred for many years. Substantial obstacles, however, have frustrated more extensive development and use of methane gas deposits in coal seams.

For example, one problem of production of gas from coal seams may be the difficulty presented at times by over-balanced drilling conditions caused by low reservoir pressure and aggravated by the porosity of the coal seam. During both vertical and horizontal surface drilling operations, drilling fluid is used to remove cuttings from the well bore to the surface. The drilling fluid exerts a hydrostatic pressure on the formation which, when exceeding the pressure of the formation, can result in a loss of drilling fluid into the formation. This results in entrainment of drill cuttings in the formation, which tends to plug the pores, cracks, and fractures that are needed to produce the gas.

Certain methods are available to drill in an under-balanced state. Using a gas such as nitrogen in the drilling fluid reduces the hydrostatic pressure, but other problems can occur, including increased difficulty in maintaining a desired pressure condition in the well system during drill string tripping and connecting operations.

SUMMARY OF THE INVENTION

The present invention provides a method and system for circulating fluid in a well system that substantially eliminates or reduces at least some of the disadvantages and problems associated with previous fluid circulation methods and systems.

In accordance with a particular embodiment of the present invention, a method for circulating drilling fluid in a well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The drilling fluid exits the drill string proximate a drill bit of the drill string. The method also includes providing fluid down the substantially vertical well bore through a tubing. The tubing has an opening at the junction such that the fluid exits the tubing at the junction. A fluid mixture returns up the substantially vertical well bore outside of the tubing. The fluid mixture comprises the drilling fluid after the drilling fluid exits the drill string.

The fluid provided down the substantially vertical well bore may comprise gas, such as compressed air. The fluid mixture returning up the substantially vertical well bore may comprise gas provided down the substantially vertical well bore through the tubing after the gas exits the tubing, fluid from the subterranean zone or cuttings from the subterranean zone. The method may also include varying a flow rate of the fluid provided down the substantially vertical well bore to achieve control a bottom hole pressure to achieve an under-balanced, over-balanced or balanced drilling condition.

In accordance with another embodiment, a method for circulating drilling fluid in a well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore at a junction proximate the subterranean zone. The method includes drilling a drainage bore from the junction into the subterranean zone and pumping a drilling fluid through the drill string when drilling the drainage bore. The drilling fluid exits the drill string proximate a drill bit of the drill string. The method also includes providing a pump string down the substantially vertical well bore. The pump string comprises a pump inlet proximate the junction. The method includes pumping a fluid mixture up the substantially vertical well bore through the pump string, the fluid mixture entering the pump string at the pump inlet. The method may include varying the speed of the pumping of the fluid mixture up the substantially vertical well bore through the pump string to control a bottom hole pressure to achieve a desired drilling condition, such as an over-balanced, under-balanced or balanced drilling condition.

Technical advantages of particular embodiments of the present invention include a method and system for circulating drilling fluid in a well system that includes providing gas down a substantially vertical well bore. The flow rate of the gas provided down the substantially vertical well bore may be varied in order to achieve a desired drilling condition, such as an over-balanced, under-balanced or balanced drilling condition. Accordingly, the flexibility of the drilling and retrieval process may be improved.

Another technical advantage of particular embodiments of the present invention includes a level of fluid in an articulated well bore that acts as a fluid seal to resist the flow of formation fluid that might escape the drill rig during a drilling process. The formation fluid resisted may comprise poisonous gas, such as hydrogen sulfide. Accordingly, drilling equipment and personnel may be isolated from the flow of poisonous gas to the surface thus increasing the safety of the drilling system.

Still another technical advantage of particular embodiments of the present invention is a method and system for circulating drilling fluid in a well system that includes pumping a fluid mixture up a substantially vertical well bore through a pump string. The fluid mixture may comprise drilling fluid used in the drilling process and cuttings from the subterranean zone. Gas from the subterranean zone may bypass the pump string enabling such gas to be recovered or flared separately from other fluid in the drilling system. Moreover, the speed of the pumping of the fluid mixture up the substantially vertical well bore may be varied to achieve a desired drilling condition, such as an over-balanced, under-balanced or balanced drilling condition.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
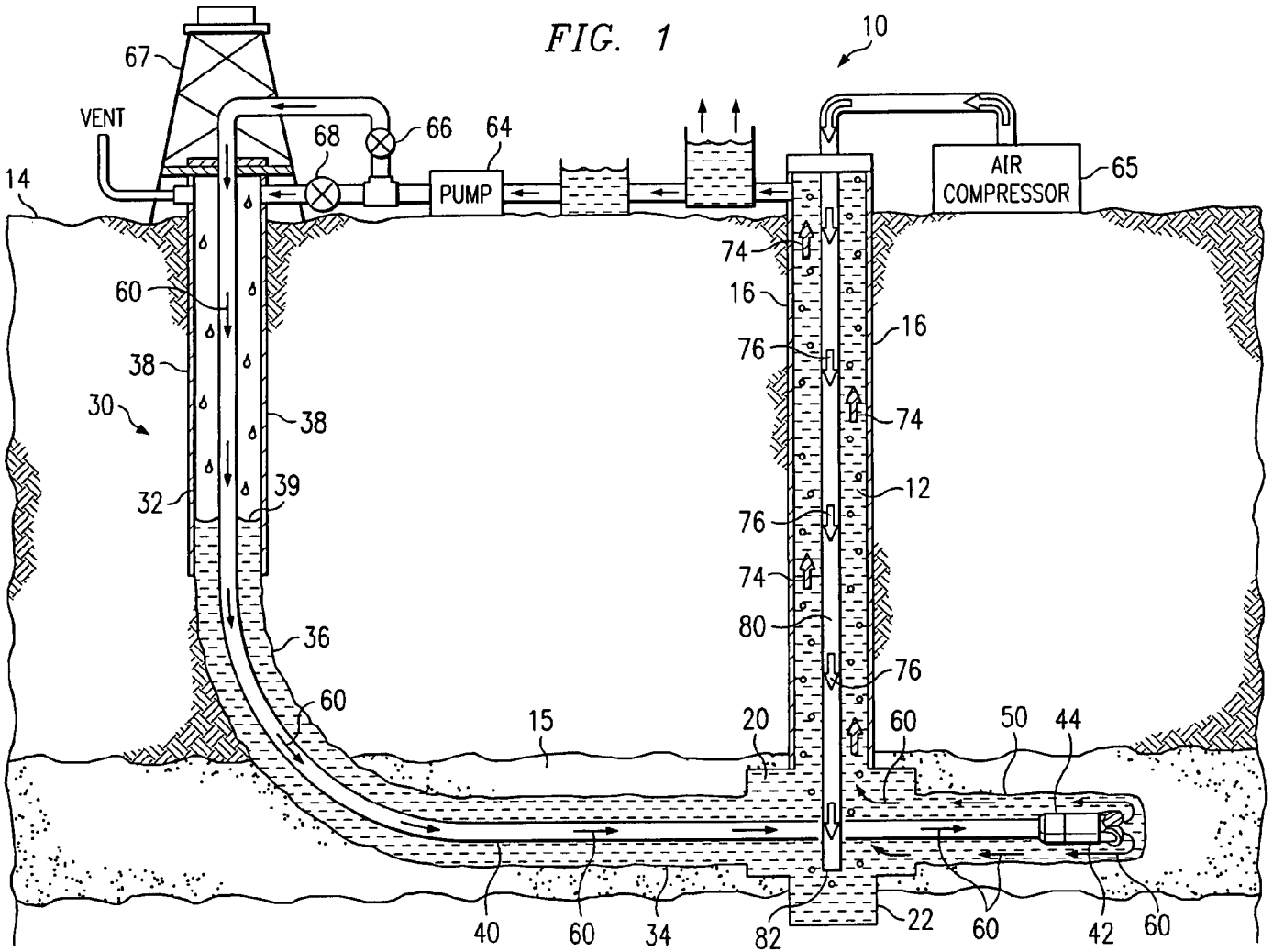
FIG. 1 illustrates the circulation of fluid in a well system in which a fluid is provided down a substantially vertical well bore through a tubing, in accordance with an embodiment of the present invention.

FIG. 1 illustrates the circulation of fluid in a well system 10. The well system includes a subterranean zone that may comprise a coal seam. It will be understood that other subterranean zones can be similarly accessed using the dual well system of the present invention to remove and/or produce water, hydrocarbons, gas and other fluids in the subterranean zone and to treat minerals in the subterranean zone prior to mining operations.

Referring to FIG. 1, a substantially vertical well bore 12 extends from a surface 14 to a target layer subterranean zone 15. Substantially vertical well bore 12 intersects and penetrates subterranean zone 15. Substantially vertical well bore 12 may be lined with a suitable well casing 16 that terminates at or above the level of the coal seam or other subterranean zone 15.

An enlarged cavity 20 may be formed in substantially vertical well bore 12 at the level of subterranean zone 15. Enlarged cavity 20 may have a different shape in different embodiments. Enlarged cavity 20 provides a junction for intersection of substantially vertical well bore 12 by an articulated well bore used to form a drainage bore in subterranean zone 15. Enlarged cavity 20 also provides a collection point for fluids drained from subterranean zone 15 during production operations. A vertical portion of substantially vertical well bore 12 continues below enlarged cavity 20 to form a sump 22 for enlarged cavity 20.

An articulated well bore 30 extends from the surface 14 to enlarged cavity 20 of substantially vertical well bore 12. Articulated well bore 30 includes a substantially vertical portion 32, a substantially horizontal portion 34, and a curved or radiused portion 36 interconnecting vertical and horizontal portions 32 and 34. Horizontal portion 34 lies substantially in the horizontal plane of subterranean zone 1S and intersects enlarged cavity 20 of substantially vertical well bore 12. In particular embodiments, articulated well bore 30 may not include a horizontal portion, for example, if subterranean zone 15 is not horizontal. In such cases, articulated well bore 30 may include a portion substantially in the same plane as subterranean zone 15.

Articulated well bore 30 may be drilled using an articulated drill string 40 that includes a suitable down-hole motor and drill bit 42. A drilling rig 67 is at the surface. A measurement while drilling (MWD) device 44 may be included in articulated drill string 40 for controlling the orientation and direction of the well bore drilled by the motor and drill bit 42. The substantially vertical portion 32 of the articulated well bore 30 may be lined with a suitable casing 38.

After enlarged cavity 20 has been successfully intersected by articulated well bore 30, drilling is continued through enlarged cavity 20 using articulated drill string 40 and appropriate horizontal drilling apparatus to drill a drainage bore 50 in subterranean zone 15. Drainage bore 50 and other such well bores include sloped, undulating, or other inclinations of the coal seam or subterranean zone 15.

During the process of drilling drainage bore 50, drilling fluid (such as drilling "mud") is pumped down articulated drill string 40 using pump 64 and circulated out of articulated drill string 40 in the vicinity of drill bit 42, where it is used to scour the formation and to remove formation cuttings. The drilling fluid is also used to power drill bit 42 in cutting the formation. The general flow of the drilling fluid through and out of drill string 40 is indicated by arrows 60.

System 10 includes a valve 66 and a valve 68 in the piping between articulated well bore 30 and pump 64. When drilling fluid is pumped down articulated drill string 40 during drilling, valve 66 is open. While connections are being made to articulated drill string 40, during tripping of the drill string or in other cases when desirable, valve 68 is opened to allow fluid (i.e. drilling fluid or compressed air) to be pumped down articulated well bore 30 outside of articulated drill string 40, in the annulus between articulated drill string 40 and the surfaces of articulated well bore 30. Pumping fluid down articulated well bore 30 outside of articulated drill string 40 while active drilling is not occurring, such as during connections and tripping of the drill string, enables an operator to maintain a desired bottom hole pressure of articulated well bore 30. Moreover, fluids may be provided through both valve 66 and valve 68 at the same time if desired. In the illustrated embodiment, valve 68 is partially open to allow fluid to fall through articulated well bore 30.

When pressure of articulated well bore 30 is greater than the pressure of subterranean zone 15 (the "formation pressure"), the well system is considered over-balanced. When pressure of articulated well bore 30 is less than the formation pressure, the well system is considered under-balanced. In an over-balanced drilling situation, drilling fluid and entrained cuttings may be lost into subterranean zone 15. Loss of drilling fluid and cuttings into the formation is not only expensive in terms of the lost drilling fluids, which must be made up, but it tends to plug the pores in the subterranean zone, which are needed to drain the zone of gas and water.

A fluid, such as compressed air or another suitable gas, may be provided down substantially vertical well bore 12 through a tubing 80. In the illustrated embodiment, gas is provided through tubing 80; however it should be understood that other fluids may be provided through tubing 80 in other embodiments. The gas may be provided through the tubing using an air compressor 65, a pump or other means. The flow of the gas is generally represented by arrows 76. The tubing has an open end 82 at enlarged cavity 20 such that the gas exits the tubing at enlarged cavity 20.

The flow rate of the gas or other fluid provided down substantially vertical well bore 12 may be varied in order to change the bottom hole pressure of articulated well bore 30. Furthermore, the composition of gas or other fluid provided down substantially vertical well bore 12 may also be changed to change the bottom hole pressure. By changing the bottom hole pressure of articulated well bore 30, a desired drilling condition such as under-balanced, balanced or over-balanced may be achieved.

The drilling fluid pumped through articulated drill string 40 mixes with the gas or other fluid provided through tubing 80 forming a fluid mixture. The fluid mixture flows up substantially vertical well bore 12 outside of tubing 80. Such flow of the fluid mixture is generally represented by arrows 74 of FIG. 1. The fluid mixture may also comprise cuttings from the drilling of subterranean zone 15 and fluid from subterranean zone 15, such as water or methane gas. Drilling fluid pumped through articulated well bore 30 outside of articulated drill string 40 may also mix with the gas to form the fluid mixture flowing up substantially vertical well bore 12 outside of tubing 80.

Articulated well bore 30 also includes a level 39 of fluid. Level 39 of fluid may be formed by regulating the fluid pump rate of pump 64 and/or the injection rate of air compressor 65. Such level of fluid acts as a fluid seal to provide a resistance to the flow of formation fluid, such as poisonous formation gas (for example, hydrogen sulfide), up articulated well bore 30. Such resistance results from a hydrostatic pressure of the level of fluid in articulated well bore 30. Thus, rig 67 and rig personnel may be isolated from formation fluid, which may include poisonous gas, flowing up and out of articulated well bore 30 at the surface. Furthermore, a larger annulus in substantially vertical well bore 12 will allow for the return of cuttings to the surface at a lower pressure than if the cuttings were returned up articulated well bore 30 outside of articulated drill string 40.

A desired bottom hole pressure may be maintained during drilling even if additional collars of articulated drill string 40 are needed, since the amount of gas pumped down substantially vertical well bore 12 may be varied to offset the change in pressure resulting from the use of additional drill string collars.

Figure 2:
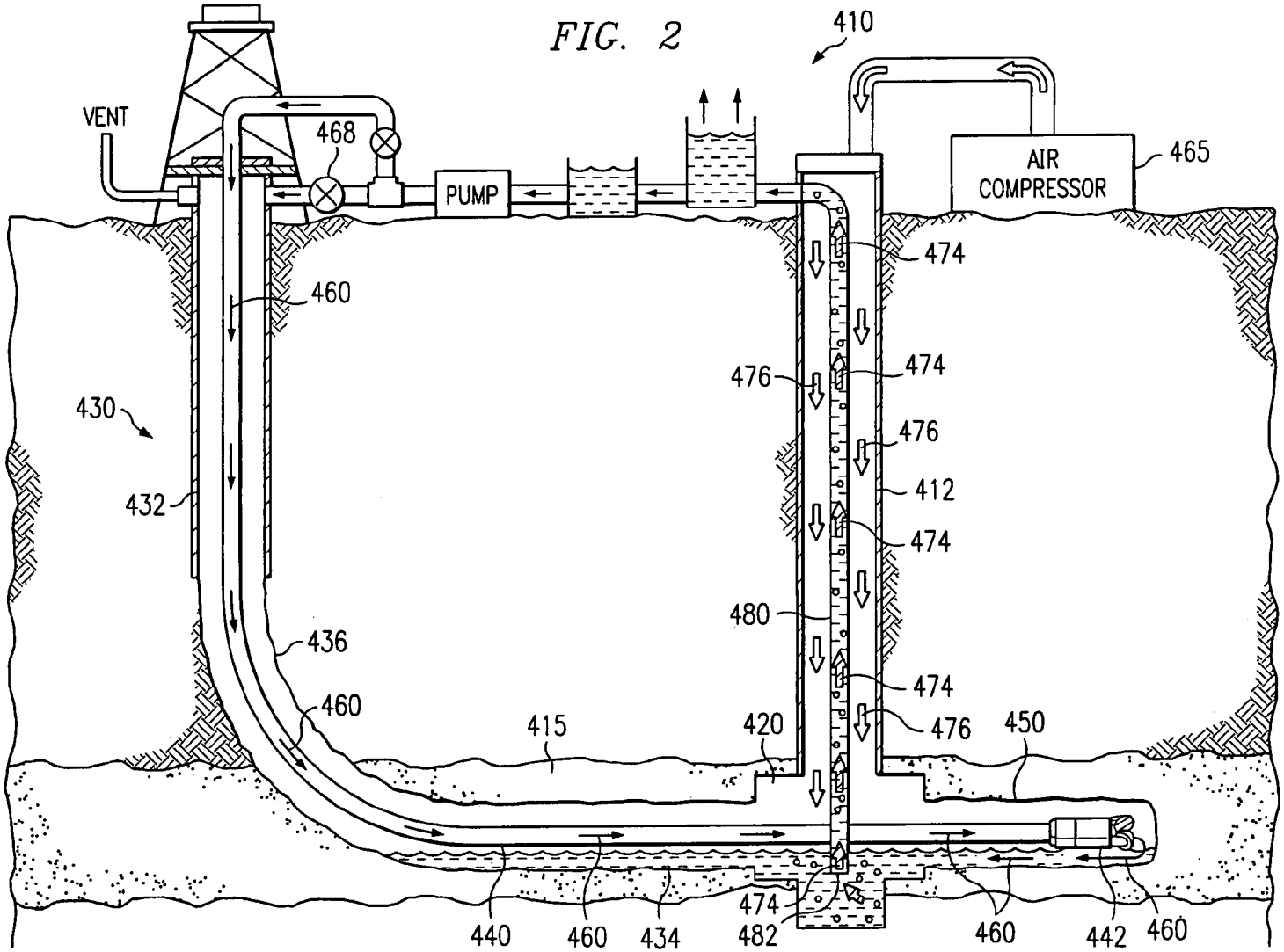
FIG. 2 illustrates the circulation of fluid in a well system in which a fluid is provided down a substantially vertical well bore, and a fluid mixture is returned up the well bore through a tubing, in accordance with an embodiment of the present invention.

FIG. 2 illustrates the circulation of fluid in a well system 410 in accordance with an embodiment of the present invention. System 410 is similar in many respects to system 10 of FIG. 1, however the circulation of fluid in system 410 differs from the circulation of fluid in system 10. System 410 includes a substantially vertical well bore 412 and an articulated well bore 430. Articulated well bore 430 intersects substantially vertical well bore 412 at an enlarged cavity 420. Articulated well bore 430 includes a substantially vertical portion 432, a curved portion 436 and a substantially horizontal portion 434. Articulated well bore intersects an enlarged cavity 420 of substantially vertical well bore 412. Substantially horizontal portion 434 of articulated well bore 430 is drilled through subterranean zone 415. Articulated well bore 430 is drilled using an articulated drill string 440 which includes a down-hole motor and a drill bit 442. A drainage bore 450 is drilled using articulated drill string 440.

A drilling fluid is pumped through articulated drill string 440 as described above with respect to FIG. 1. The general flow of such drilling fluid is illustrated by arrows 460. The drilling fluid may mix with fluid and/or cuttings from subterranean zone 450 after the drilling fluid exits articulated drill string 440. Using valve 468, fluids may be provided down articulated well bore 430 outside of articulated drill string 440 during connection or tripping operations or otherwise when desirable, such as the falling fluid illustrated in FIG. 1.

A fluid, such as compressed air, may be provided down substantially vertical well bore 412 in the annulus between a tubing 480 and the surface of substantially vertical well bore 412. In the illustrated embodiment, gas is provided down substantially vertical well bore 412 outside of tubing 480; however it should be understood that other fluids may be provided in other embodiments. The gas or other fluid may be provided using an air compressor 465, a pump or other means. The flow of the gas is generally represented by arrows 476.

The flow rate of the gas or other fluid provided down substantially vertical well bore 412 may be varied in order to change the bottom hole pressure of articulated well bore 430. Furthermore, the composition of gas or other fluid provided down substantially vertical well bore 412 may also be changed to change the bottom hole pressure. By changing the bottom hole pressure of articulated well bore 430, a desired drilling condition such as under-balanced, balanced or over-balanced may be achieved.

The drilling fluid pumped through articulated drill string 440 mixes with the gas or other fluid provided down substantially vertical well bore 412 outside of tubing 480 to form a fluid mixture. The fluid mixture enters an open end 482 of tubing 480 and flows up substantially vertical well bore 412 through tubing 480. Such flow of the fluid mixture is generally represented by arrows 474. The fluid mixture may also comprise cuttings from the drilling of subterranean zone 415 and fluid from subterranean zone 415, such as water or methane gas. Fluid pumped through articulated well bore 430 outside of articulated drill string 440 may also mix with the gas to form the fluid mixture flowing up substantially vertical well bore 412 outside of tubing 480.

Figure 3:
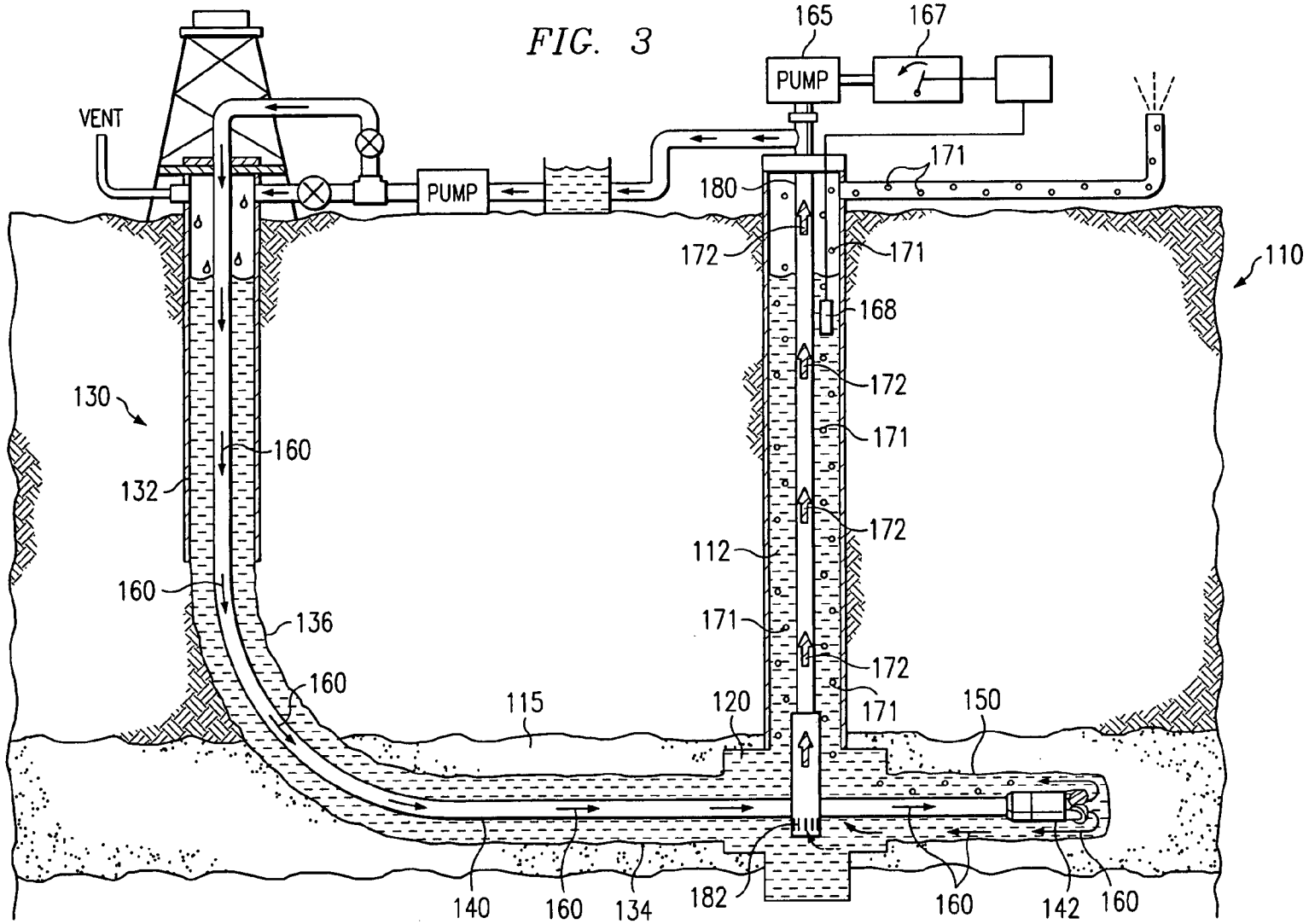
FIG. 3 illustrates the circulation of fluid in a well system in which a fluid mixture is pumped up a substantially vertical well bore through a pump string, in accordance with an embodiment of the present invention.

FIG. 3 illustrates the circulation of fluid in a well system 110 in accordance with an embodiment of the present invention. System 110 includes a substantially vertical well bore 112 and an articulated well bore 130. Articulated well bore 130 intersects substantially vertical well bore 112 at an enlarged cavity 120. Articulated well bore 130 includes a substantially vertical portion 132, a curved portion 136 and a substantially horizontal portion 134. Articulated well bore intersects an enlarged cavity 120 of substantially vertical well bore 112. Substantially horizontal portion 134 of articulated well bore 130 is drilled through subterranean zone 115. Articulated well bore 130 is drilled using an articulated drill string 140 which includes a down-hole motor and a drill bit 142. A drainage bore 150 is drilled using articulated drill string 140.

Substantially vertical well bore 112 includes a pump string 180 which comprises a pump inlet 182 located at enlarged cavity 120. A drilling fluid is pumped through articulated drill string 140 as described above with respect to FIG. 1. The general flow of such drilling fluid is illustrated by arrows 160. The drilling fluid may mix with fluid and/or cuttings from subterranean zone 150 to form a fluid mixture after the drilling fluid exits articulated drill string 140.

The fluid mixture is pumped up through substantially vertical well bore 112 through pump inlet 182 and pump string 180 using pump 165, as generally illustrated by arrows 172. Formation gas 171 from subterranean zone 115 flows up substantially vertical well bore 112 to areas of lower pressure, bypassing pump inlet 182. Thus, particular embodiments of the present invention provide a manner for pumping fluid out of a dual well system through a pump string and limiting the amount of formation gas pumped through the pump string. Formation gas 171 may be flared as illustrated or recovered.

The speed of the pumping of the fluid mixture up substantially vertical well bore 112 through pump string 180 may be varied to change the fluid level and bottom hole pressure of system 110. By changing the fluid level and bottom hole pressure, a desired drilling condition such as under-balanced, balanced or over-balanced may be achieved. Substantially vertical well bore 112 includes a pressure sensor 168 operable to detect a pressure in substantially vertical well bore 112. Pressure sensor 168 may be electrically coupled to an engine 167 of pump 165 to automatically change the speed of pump 165 based on the pressure at a certain location in system 110. In other embodiments, the speed of pump 165 may be varied manually to achieve a desired drilling condition.

While connections are being made to articulated drill string 140, during tripping of the drill string or in other cases when desirable, drilling fluid may be pumped through articulated well bore 130 outside of articulated drill string 140. Such drilling fluid may mix with fluid and/or cuttings from subterranean zone 150 to form the fluid mixture pumped up substantially vertical well bore 112 through pump string 180.

Figure 4:
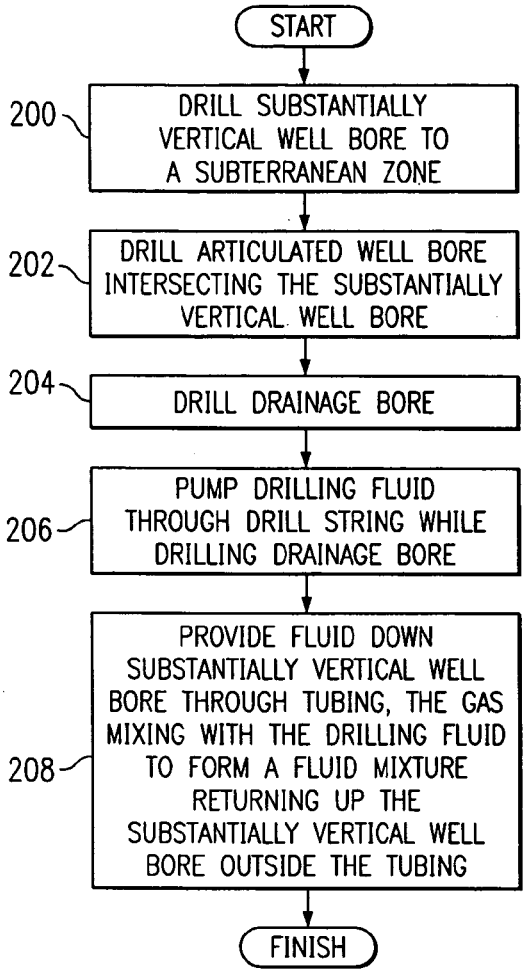
FIG. 4 is a flow chart illustrating an example method for circulating fluid in a well system in which a fluid is provided down a substantially vertical well bore through a tubing, in accordance with an embodiment of the present invention.

FIG. 4 is a flowchart illustrating an example method for circulating fluid in a well system in accordance with an embodiment of the present invention. The method begins at step 200 where a substantially vertical well bore is drilled from a surface to a subterranean zone. In particular embodiments, the subterranean zone may comprise a coal seam or a hydrocarbon reservoir. At step 202 an articulated well bore is drilled from the surface to the subterranean zone. The articulated well bore is drilled using a drill string. The articulated well bore is horizontally offset from the substantially vertical well bore at the surface and intersects the substantially vertical well bore at a junction proximate the subterranean zone. The junction may be at an enlarged cavity.

Step 204 includes drilling a drainage bore from the junction into the subterranean zone. At step 206, a drilling fluid is pumped through the drill string when the drainage bore is being drilled. The drilling fluid may exit the drill string proximate a drill bit of the drill string.

At step 208, gas, such as compressed air, is provided down the substantially vertical well bore through a tubing. In other embodiments, other fluids may be provided down the substantially vertical well bore through the tubing. The tubing includes an opening at the junction such that the gas exits the tubing at the junction. In particular embodiments, the gas mixes with the drilling fluid to form a fluid mixture that returns up the substantially vertical well bore outside of the tubing. The fluid mixture may also include fluid and/or cuttings from the subterranean zone. The flow rate or composition of the gas or other fluid provided down the substantially vertical well bore may be varied to control a bottom hole pressure of the system to achieve a desired drilling condition, such as an over-balanced, under-balanced or balanced drilling condition.

Figure 5:
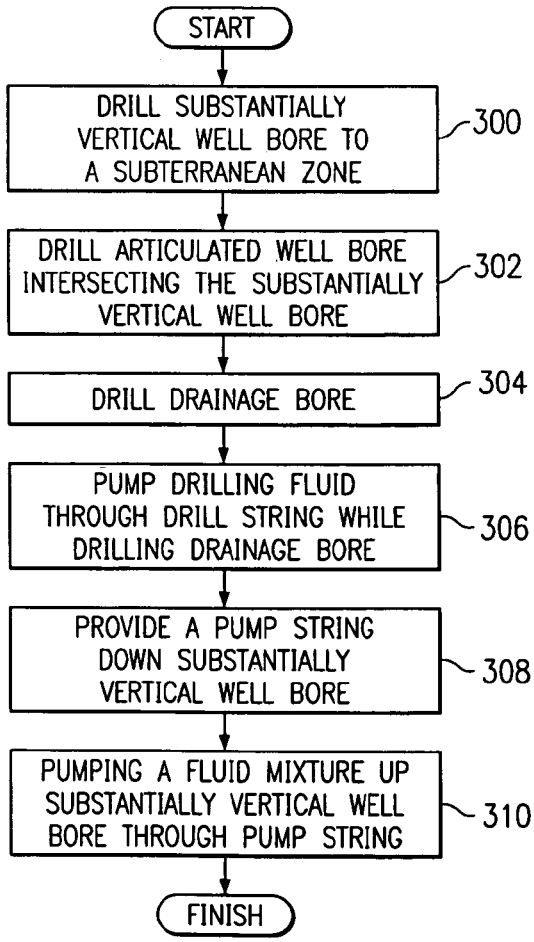
FIG. 5 is a flow chart illustrating an example method for circulating fluid in a well system in which a fluid mixture is pumped up a substantially vertical well bore through a pump string, in accordance with an embodiment of the present invention.

FIG. 5 is a flowchart illustrating an example method for circulating fluid in a well system in accordance with an embodiment of the present invention. The method begins at step 300 where a substantially vertical well bore is drilled from a surface to a subterranean zone. In particular embodiments, the subterranean zone may comprise a coal seam or a hydrocarbon reservoir. At step 302 an articulated well bore is drilled from the surface to the subterranean zone. The articulated well bore is drilled using a drill string. The articulated well bore is horizontally offset from the substantially vertical well bore at the surface and intersects the substantially vertical well bore at a junction proximate the subterranean zone. The junction may be at an enlarged cavity.

Step 304 includes drilling a drainage bore from the junction into the subterranean zone. At step 306, a drilling fluid is pumped through the drill string when the drainage bore is being drilled. The drilling fluid may exit the drill string proximate a drill bit of the drill string. At step 308, a pump string is provided down substantially vertical well bore. The pump string includes a pump inlet proximate the junction. At step 310, a fluid mixture is pumped up substantially vertical well bore through the pump string. The fluid mixture enters the pumps string at the pump inlet. The fluid mixture may comprise the drilling fluid after the drilling fluid exits the drill string, fluid from the subterranean zone and/or cuttings from the subterranean zone. The speed of the pumping of the fluid mixture up the substantially vertical well bore through the pump string may be varied to control a bottom hole pressure to achieve a desired drilling condition, such as an over-balanced, under-balanced or balanced drilling condition.

Although the present invention has been described in detail, various changes and modifications may be suggested to one skilled in the art. It is intended that the present invention encompass such changes and modifications as falling within the scope of the appended claims.

What is claimed is:

1. A system comprising:

a substantially vertical well bore extending from a surface to a subterranean zone;

an articulated well bore extending from the surface to the subterranean zone and intersecting the substantially vertical well bore at a junction proximate the subterranean zone;

a drainage bore extending from the junction into the subterranean zone;

a drill string disposed within the articulated well bore, the drill string extending into the drainage bore;

a drilling fluid provided through the drill string and exiting the drill string proximate a drill bit of the drill string;

a tubing disposed within the substantially vertical well bore, the tubing having an open end at the junction;

a second fluid provided down the substantially vertical well bore, the second fluid exiting the tubing at the junction; and a fluid mixture returning up the substantially vertical well bore outside of the tubing, the fluid mixture comprising the drilling fluid after the drilling fluid exits the drill string.

2. The system of claim 1, wherein the second fluid provided down the substantially vertical well bore comprises gas provided down the substantially vertical well bore.

3. The system of claim 2, wherein the fluid mixture comprises at least one of:

the gas provided down the substantially vertical well bore after the gas exits the tubing;

fluid from the subterranean zone; and cuttings from the subterranean zone.

4. The system of claim 1, further comprising a fluid seal in the articulated well bore, the fluid seal comprising a level of fluid that resists gas from the subterranean zone from flowing up the articulated well bore.

5. The system of claim 1, wherein the flow rate of the second fluid provided down the substantially vertical well bore is varied to control a bottom hole pressure of the system to achieve a desired drilling condition.

6. The system of claim 5, wherein the desired drilling condition is an under-balanced drilling condition.

7. The system of claim 1, wherein the subterranean zone comprises a coal seam.

8. The system of claim 1, wherein the subterranean zone comprises a hydrocarbon reservoir.

9. The system of claim 1, wherein the second fluid provided down the substantially vertical well bore comprises compressed air.

10. A system comprising:

a substantially vertical well bore extending from a surface to a subterranean zone;

an articulated well bore extending from the surface to the subterranean zone and intersecting the substantially vertical well bore at a junction proximate the subterranean zone;

a drainage bore extending from the junction into the subterranean zone;

a drill string disposed within the articulated well bore, the drill string extending into the drainage bore;

a drilling fluid provided through the drill string and exiting the drill string proximate a drill bit of the drill string;

a tubing disposed within the substantially vertical well bore, the tubing having an opening at the junction;

a second fluid provided down the substantially vertical well bore outside the tubing; and a fluid mixture entering the opening of the tubing at the junction and returning up the substantially vertical well bore through the tubing, the fluid mixture comprising the drilling fluid after the drilling fluid exits the drill string.

11. The system of claim 10, wherein the second fluid provided down the substantially vertical well bore comprises gas provided down the substantially vertical well bore.

12. The system of claim 11, wherein the fluid mixture comprises at least one of:

the gas provided down the substantially vertical well bore;

fluid from the subterranean zone; and cuttings from the subterranean zone.

13. The system of claim 10, wherein the flow rate of the second fluid provided down the substantially vertical well bore is varied to control a bottom hole pressure of the system to achieve a desired drilling condition.

14. The system of claim 13, wherein the desired drilling condition is an under-balanced drilling condition.

15. The system of claim 10, wherein the subterranean zone comprises a coal seam.

16. The system of claim 10, wherein the subterranean zone comprises a hydrocarbon reservoir.

17. The system of claim 10, wherein the fluid provided down the substantially vertical well bore comprises compressed air.

18. A system comprising:

a substantially vertical well bore extending from a surface to a subterranean zone;

an articulated well bore extending from the surface to the subterranean zone and intersecting the substantially vertical well bore at a junction proximate the subterranean zone;

a drainage bore extending from the junction into the subterranean zone;

a drill string disposed within the articulated well bore, the drill string extending into the drainage bore;

a drilling fluid provided through the drill string and exiting the drill string proximate a drill bit of the drill string;

a pump string disposed within the substantially vertical well bore, the pump string comprising a pump inlet proximate the junction; and a fluid mixture entering the pump string at the pump inlet and pumped up the substantially vertical well bore through the pump string.

19. The system of claim 18, wherein the fluid mixture comprises at least one of:

the drilling fluid after the drilling fluid exits the drill string;

fluid from the subterranean zone; and cuttings from the subterranean zone.

20. The system of claim 18, further comprising a fluid seal in the articulated well bore, the fluid seal comprising a level of fluid that resists gas from the subterranean zone from flowing up the articulated well bore.

21. The system of claim 18, further comprising a pressure sensor provided down the substantially vertical well bore, the pressure sensor operable to detect a pressure of the substantially vertical well bore.

22. The system of claim 18, further comprising a pump operable to vary the speed of the pumping of the fluid mixture up the substantially vertical well bore through the pump string to control a bottom hole pressure of the system to achieve a desired drilling condition.

23. The system of claim 22, wherein the desired drilling condition is an under-balanced drilling condition.

24. The system of claim 18, wherein the subterranean zone comprises a coal seam.

25. The system of claim 18, wherein the subterranean zone comprises a hydrocarbon reservoir.

* * * * *